US009841209B2

(12) United States Patent
Alvise et al.

(10) Patent No.: US 9,841,209 B2
(45) Date of Patent: Dec. 12, 2017

(54) EVAPORATOR ROUGH-IN BOX

(71) Applicant: POLAR INDUSTRIA DE PLASTICOS LTDA., Joinville SC (BR)

(72) Inventors: Dalvir Alvise, Joinville SC (BR); Gerald S Spanger, Edison, NJ (US)

(73) Assignee: POLAR INDUSTRIA DE PLASTICOS LTDA., Joinville SC (BR)

( * ) Notice: Subject to any disclaimer, the term of this patent is extended or adjusted under 35 U.S.C. 154(b) by 0 days.

(21) Appl. No.: 15/602,443

(22) Filed: May 23, 2017

(65) Prior Publication Data

US 2017/0254560 A1 Sep. 7, 2017

Related U.S. Application Data

(63) Continuation of application No. 15/408,769, filed on Jan. 18, 2017.

(60) Provisional application No. 62/281,816, filed on Jan. 22, 2016.

(51) Int. Cl.

| | |
|---|---|
| ***F25D 21/14*** | (2006.01) |
| ***F24F 13/22*** | (2006.01) |
| ***F24F 1/00*** | (2011.01) |
| ***F24F 1/32*** | (2011.01) |
| ***F24F 13/32*** | (2006.01) |

(52) U.S. Cl.

CPC ..... *F24F 13/222* (2013.01); *F24F 1/0003* (2013.01); *F24F 1/32* (2013.01); *F24F 13/32* (2013.01); *F24F 2013/227* (2013.01)

(58) Field of Classification Search

CPC ..... F24F 13/222; F24F 1/32; F24F 2013/277
USPC ..... 220/571; 258/148.22
See application file for complete search history.

(56) References Cited

U.S. PATENT DOCUMENTS 6,196,015 B1 * 3/2001 Pignolo ..... F24F 1/00 62/272
6,321,554 B1 * 11/2001 Rigoni ..... F24F 1/0003 62/259.1

FOREIGN PATENT DOCUMENTS

BR MU-8700323-6 U * 10/2008 ..... H02G 3/10

* cited by examiner

*Primary Examiner* — Orlando E Aviles Bosques
(74) *Attorney, Agent, or Firm* — Oliff PLC

(57) ABSTRACT

An evaporator rough-in box includes a plurality of walls that define and enclose a chamber, a first one of the walls having cutting lines that encircle a faceplate, one of the cutting lines defining an integral hinge that maintains the faceplate attached to the first one of the walls when a remainder of the cutting lines are cut so that the faceplate can move between an open position and a closed position. A closure maintains the faceplate in the closed position by attaching an edge of the faceplate to the first one of the walls. In addition, ports are provided in at least one of the walls, and a drainage sump is provided at a vertically lower end of the rough-in box, the drainage sump having a drain outlet.

26 Claims, 26 Drawing Sheets

EVAPORATOR ROUGH-IN BOX

This is a Continuation of U.S. application Ser. No. 15/408,769 filed Jan. 18, 2017, which claims the benefit of U.S. Provisional Application No. 62/281,816, filed Jan. 22, 2016. The contents of each of the prior applications is incorporated herein by reference in its entirety.

BACKGROUND

The disclosure relates to so-called rough-in boxes that can be used during construction to hold various components that are used to support air conditioner systems such as, for example, mini-split air conditioners.

All mini-split air conditioner evaporators require a minimum of two mechanical connections and one electrical connection to operate, namely: (1) a lineset having two or more insulated copper pipes connecting the evaporator to the condenser; (2) a power cable; and (3) a gravity condensate drainage method which usually requires connection to the building's drain pipe system, or may be routed to a convenient drain point outside the building, or may use a pump to evacuate the condensate, for example, in installations where the condensate must be fed upward and thus gravity cannot be utilized to facilitate gravity drainage.

In many countries, to reduce costs, modern interior walls (and some exterior walls) consist of a framework constructed of wooden studs typically used for residential applications, or metal studs typically used for commercial applications. Once all the services such as electrical, plumbing, mechanical, etc. have been installed, this framework is then clad on both sides with Gypsum boards (commonly known as sheetrock) to form a wall with an internal cavity which is often filled with Fiberglass or foam to provide thermal and/or sound insulation.

In new construction, this requires the air conditioning installer to preposition the above-mentioned three inputs into a stud wall frame prior to sheet rocking and this in turn creates at least two problems. First, it is difficult for the installer to determine the correct position of the three inputs relative to the final position of the air conditioner and as a result, they often emerge from the wall in the wrong position, creating substantial problems when they have to be connected during the installation phase. Second, it is necessary for the installer to leave some pipe and cable sticking out of the finished wall so the air conditioner can be installed and connected up after the sheetrock and painting have been completed, and these items (the pipe and cable) are consistently damaged and covered with mud during the sheet rocking process. The items (pipe and cable) are also subject to severe mechanical damage by tradesmen installing other services such as electrical, plumbing, data and alarm.

It is therefore very desirable to provide a way to ensure that these service connections will not only emerge from the wall in the correct orientation to the air conditioner but also that the piping and wiring itself is shielded from damage until such time as it is ready for final connection to the air conditioner. These issues have been addressed in the past by the introduction of a "rough-in box", which is a plastic box pre-mounted into the wall cavity in the approximate position where the air conditioner (having the evaporator unit) is to be placed and which is pre-piped and prewired with all the necessary connections, leaving sufficient slack inside the box so that these services can easily be connected into the air conditioner during the installation process. After initial installation, an open front side of the box with the enclosed wires and piping is covered up with a removable cover plate which is left in place to protect the contents during all subsequent installation activities up to and including the final process of painting. After painting is completed, the cover is removed, exposing the pristine contents ready for connection to the air conditioner.

Installation aids of this nature have been available for some time in various configurations and sizes, however they all have a number of shortcomings and can be improved. There are a number of injection molded plastic boxes available from various European and Asian manufacturers all of which disclose a simple rectangular box with an open front and a sloped drainage sump at the bottom which terminates in a drain outlet. Also included are some knock-outs on the top and sides through which the pipes and cables can be introduced into the box. The box may be closed with a separate cover which is attached with screws. A box also is available from Polar of Brazil, which is manufactured under Brazilian Patent Number 8,700,323-6, and which discloses a single piece blow molded box with an integral faceplate and a sloped drainage sump at the bottom which terminates in a drain outlet. Also included are some knock-outs on the top and sides. With this single piece blow molded box, the installer must insert the cables and tubing into the box blind (that is, without being able to see the positions of these items within the box). There thus is room for improvement of the known rough-in boxes.

SUMMARY

According to one aspect, a rough-in box includes a faceplate equipped with an integral hinge on its bottom edge or, any of its three other edges, so that, after the other three edges are cut, using the uncut edge as a hinge, the faceplate can be folded open to provide complete access with full visibility for the installer to easily insert the lineset and cable into their correct positions inside the box. Also included is a closure for keeping the faceplate in the vertical, or closed, position during the subsequent building and finishing operations to protect the contents of the box. According to a preferred embodiment, the closure is one or more clips. However, other structures such as screws or hook-and-loop fastener strips, for example, can be used as well as a pressure fit to secure the faceplate, and can be attached to the top or any other side of the faceplate to prevent it from inadvertently opening until access is required to complete the installation process. Once finishing operations are completed, the faceplate is removed by simply undoing whatever closure method is used and cutting along the hinged edge, thus exposing the pipe and wiring for the installer to make the final connections to the air conditioner.

The above described aspect addresses problems that occur in boxes that are closed on all sides and that require blind insertion of the pipes and cables into the box. Because the copper lineset is relatively inflexible, installation of the lineset into the box is a difficult and delicate procedure, which is easier to perform with full visibility of the box interior and of the cable and piping that is being introduced into it. Providing the hinged faceplate that can be closed after installation of the lineset eases use and improves the installation while still protecting the contents.

According to another aspect, a rough-in box includes an inlet port for the refrigerant lineset which incorporates a rolled edge with sufficient radius to provide a rounded surface without sharp edges to facilitate the insertion of the lineset into the box. The rounded edge eliminates any possibility of cutting or tearing of the insulation that is typically provided on the tubing of the refrigerant lineset.

Some existing boxes have a number of raised ports, all of which are capped as part of the manufacturing process. The installer then selects the port that he intends to use and removes the cap to expose the opening underneath it. This poses no problem for the electrical connection, which simply requires a round hole into which a cable gland is fitted and through which the cable is subsequently inserted into the box. However, for the refrigerant lineset, this creates a major problem in that when the two or more copper pipes, which are both insulated, are inserted into the port on the box which has a raw edge, the insulation catches on this raw edge making it difficult for the installer to pull the lineset into the box. Further, this raw edge often cuts and/or tears the insulation during the insertion process, leaving uninsulated areas on the lineset, which will lead to sweating with the potential for unsightly and damaging water leaks on the wall beneath the air conditioner. Providing a rough-in box that includes an inlet port for the refrigerant lineset which incorporates a roiled edge, as described above, eliminates this problem of existing boxes.

According to another aspect, a rough-in box includes two or more integral mounting surfaces which can be placed at the top, the bottom or any of the four corners of the box. Each of these mounting surfaces incorporates a simple ratchet device (for example, a series of teeth) or any other means of adjustment which enables adjustment of the position of a mounting bracket that engages the mounting surface for mounting the box to wall studs. Each of the mounting brackets (at least two, and up to four mounting brackets can be used) can have its position adjusted to extend/retract by up to approximately 1.25 inches (3.0 cm), for example, so it can reach into the web of the wall stud and easily then be attached to the flat surface. The mounting brackets can be made of plastic or metal. This provides a further advantage in that only one size of the box is required because the box can be mounted with the extendable brackets facing in either direction, or, should the situation arise where the flat sides of the two studs are both facing outwards, the box could still be used by extending the brackets on both sides. In addition, notches can be provided on arms of the brackets so that flanges of metal studs will be accommodated by the notches when the recessed side (the non-flat side) of the metal stud faces the rough-in box.

Many existing boxes have no specific means of attachment into the wall space, and no adjustment for any variations therein. In wooden stud construction, this is of little importance as the box can simply be fixed into the wood studs at either end by a screw through the end plates. However, in metal stud construction, this is of paramount importance because metal studs typically are made in a U-Shape cross-section and are always installed facing the same direction. This means that in any given stud space, one side will present a flat surface, which is formed by the bottom of the stud facing into the space. On the other side, however, there will not be a flat surface as there will be a recess formed by the upright legs of the stud. This recess typically is approximately 1.25 inches deep. A further complication is that when these boxes are installed, the orientation of the metal studs can be in either direction, which would then require a similarly oriented box, i.e., one model of box with the mounting structures on the left side and another version with the mounting structure on the right side. The above-described aspect, having the adjustable brackets, addresses these issues.

Although a condensate drainage pipe system typically is installed for an air conditioning system, in approximately 10 to 15% of installations, the use of condensate drainage pipe systems is not possible, and in these case, a separate aftermarket condensate pump has to be used. Sometimes an externally mounted pump can be utilized, however in many cases it is desirable to install a concealed pump, and no existing boxes make any provision for an arrangement of this nature.

According to another aspect, and to facilitate the use of a condensate pump, a rough-in box includes a flat plate to be clipped into the box at a point above the sloped drainage sump, thus providing a stable base on which to mount the reservoir of a condensate pump, as well as, if required, the actual pump mechanism, which is often a separate component, although it can also be a Monobloc type, i.e., a single mechanism. Further, the faceplate of the box, which is removed when the air conditioner is installed, may be cut to size and clipped into position inside the box to provide a base for the pump and/or reservoir assembly, thus eliminating the need for the installer to fabricate a separate mounting plate. The base is further designed with reinforcing strips included in it to provide a very stable base for the pump/reservoir which will prevent any vibration which can result in a noise within the conditioned space. This feature may be left unused if a more substantial mounting base is required in which case the installer would acquire a mounting base made from a heavier material.

According to another aspect, a rough-in box includes a drain outlet assembly which has a threaded nipple, to the open end of which are attached two barbs, one suitable for a 16 MM inner diameter flexible hose, at the end of which another barb suitable for a 14 MM inner diameter flexible hose is attached. This enables the installer to select either the threaded nipple or whichever barb size he requires for his particular installation. Existing boxes have either a threaded or plain nipple, which is intended to connect to a rigid PVC pipe system, and make no provision for those instances where a flexible drain hose, usually 16 MM inner diameter if plain hose is used, or 14 MM inner diameter if insulated hose is used. The above-described aspect addresses this issue and eliminates the need for a special adaptor.

Existing boxes have no means of access from the rear in cases where this is required for maintenance or repairs to the pump, reservoir or air conditioner, for example. Such boxes have a rear face that is fixed and which is not designed to be removed, thus eliminating the possibility of any future access from the rear should this become necessary or desirable.

According to another aspect, and to facilitate access from the rear, a rough-in box includes a provision to cut out the rear faceplate of the box. For example, a thinned cutting line that can be similar to the thinned cutting line provided on the front faceplate of the box, can be provided on the rear faceplate of the box. By cutting a corresponding hole in the sheetrock on the other side of the wall, and cutting through the cutting line on the rear faceplate, an opening will be produced which will permit access from the rear to the components inside of the box. When not in use (that is, after the box has been accessed from the rear and the repairs, etc. are made), the hole can be covered by a decorative faceplate which may be supplied separately. In the event that no rear access is required, this option can be left unused (that is, the thinned cutting line is not cut), and, in the event that it is not utilized during initial installation and rear access becomes desirable at a later date, it can easily be accessed.

Existing boxes provide no frame of reference which the sheetrocker can use during the installation process to cut a hole into the sheetrock which corresponds with the opening of the box.

According to another aspect, and to address the above-identified issue, a rough-in box includes a one piece box which includes a protruding frame (protruding, for example, by 0.5 inches (1.3 cm)) that provides a definitive edge on the front of the box. The front surface of the frame will be flush with the exterior surface of the sheetrock on the front of the wall. This provides a specific frame to which the sheetrocker can tailor the sheetrock and which will result in a neatly framed hole in the sheetrock in the correct orientation to accommodate the air conditioner. In addition, a protruding frame may be provided on each of the front and back surfaces of the box, providing complete reversibility. In addition, marking pins can be provided with the rough-in box to aid in its installation. In particular four marking pins can be provided, each being attachable to a corresponding one of the four corners of protruding frame and having a sharp marking portion that protrudes forwardly when attached to the rough-in box. The marking portion of each marking pin will penetrate and thus mark the sheetrock so that the installer can easily locate the mounted rough-in box and cut an appropriate hole through the sheetrock to access the rough-in box. The marking pins can be removed after the hole has been cut through the sheetrock.

Some existing boxes provide a side entry which features a sloped semicircular sump of approximately 1.25 inches in diameter at the bottom of the box and which runs from one end of the box to the other at an angle of around 30 degrees and which terminates in a symmetrical threaded fitting of 0.75 inches in inner diameter. Because the actual outlet side is smaller than the inlet side, and the diameters are concentric, this creates a small area in this fitting from which all the condensate will not be able to drain out, creating a "dead space" in which the water will tend to collect and promote the growth of algae, mold and mildew, etc.

According to another aspect, the above-identified issue is addressed by providing a rough-in box that includes a sump which terminates in an asymmetrical fitting so there is no low area from which the water cannot drain, thus eliminating the above-identified problem.

According to another aspect, the rough-in box may be fabricated or mass produced from any kind of plastic, or any other kind of non-metallic material including fiberglass or carbon fiber. The box may be produced by injection molding, vacuum molding, rotational molding, blow molding or any other method of fabrication. The box may be fabricated, pressed or molded from any kind of metal. The box may be square or rectangular in form or it could also be round, triangular or any other geometric shape which does not interfere with the required function.

In some embodiments, couplings can be provided to couple the AC unit condensate line to the drain line of the building. In this case, the liquid condensate does not flow into the sump but instead flows directly from the AC unit condensate line into the drain line of the building. This enables the condensate line clog detector of the AC unit to detect clogging of the drain line that is connected to the drain outlet of the sump. This also prevents liquid from being present within the rough-in box, which may be a requirement of certain building codes that prohibit the collection of liquid within a rough-in box.

DETAILED DESCRIPTION OF EMBODIMENTS

Figure 1:
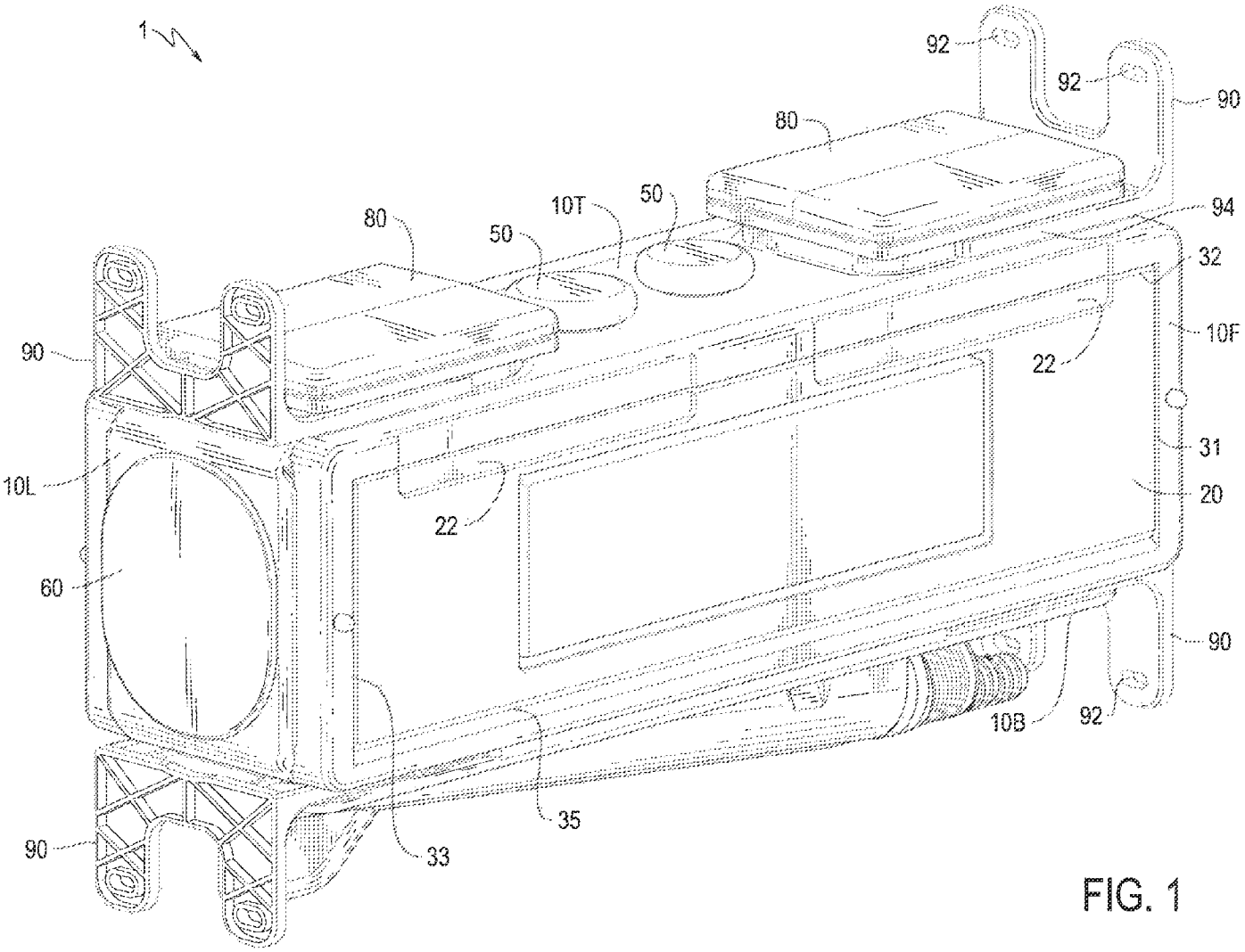
FIG. 1 is a front, top, left-side perspective view of a first embodiment rough-in Box.
Figure 2:
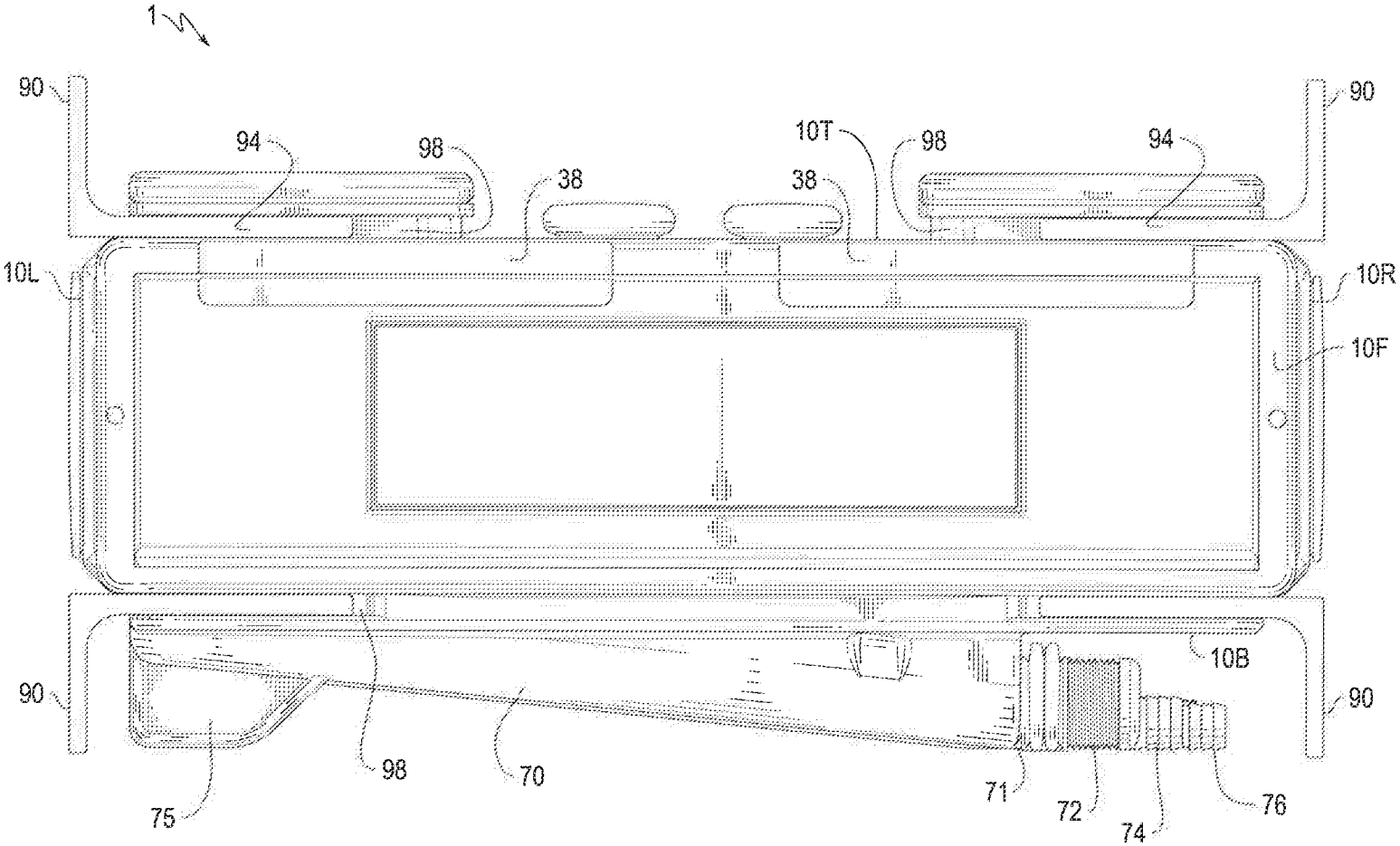
FIG. 2 is a front elevational view of the rough-in box according to the first embodiment.
Figure 3:
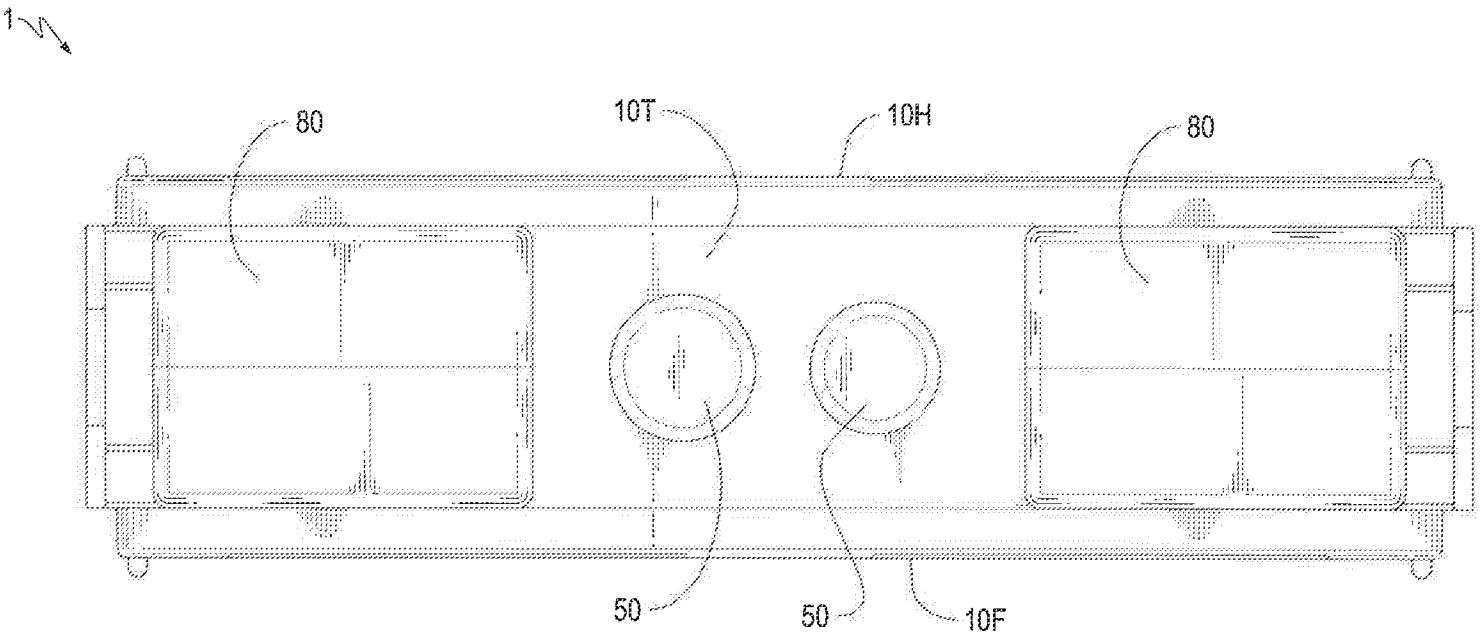
FIG. 3 is a top plan view of the rough-in box according to the first embodiment.
Figure 5:
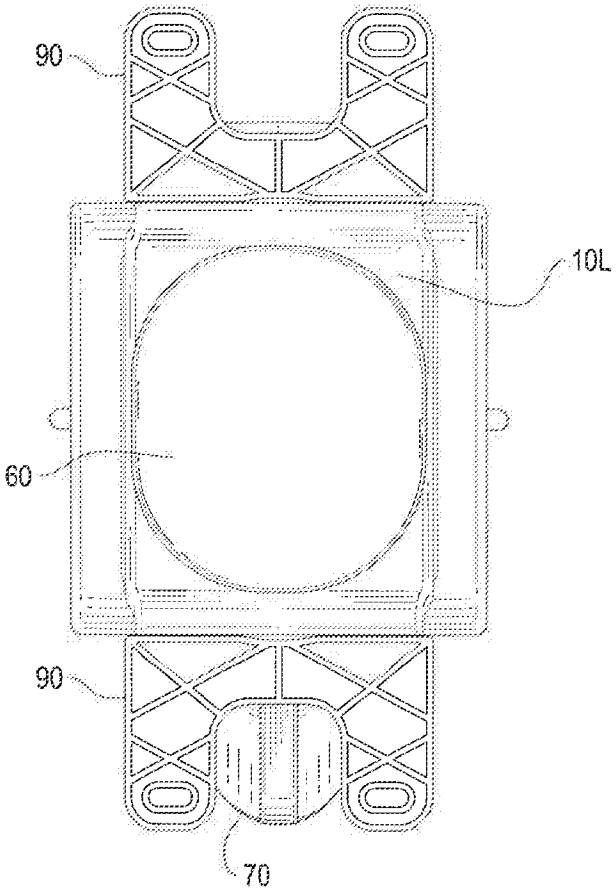
FIGS. 4 and 5 are right and left elevational views, respectively, of the rough-in box according to the first embodiment.
Figure 4:
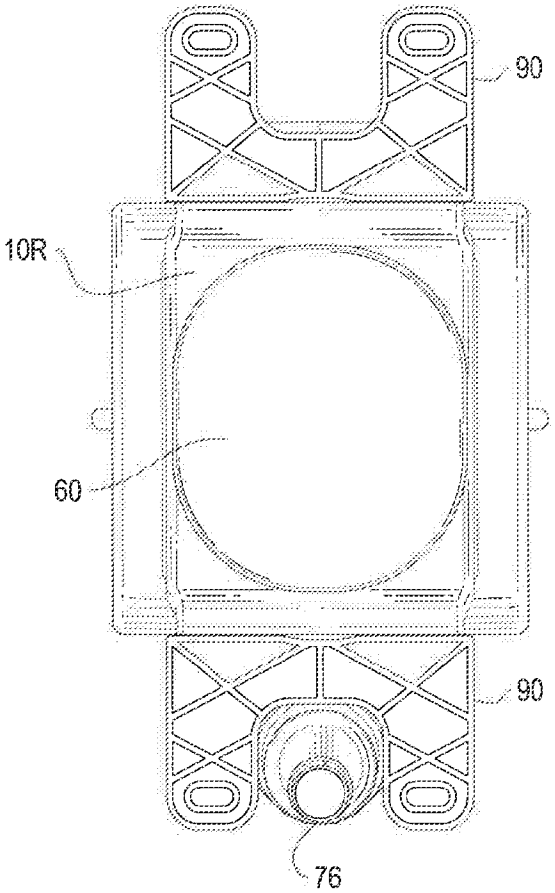
Figure 6:
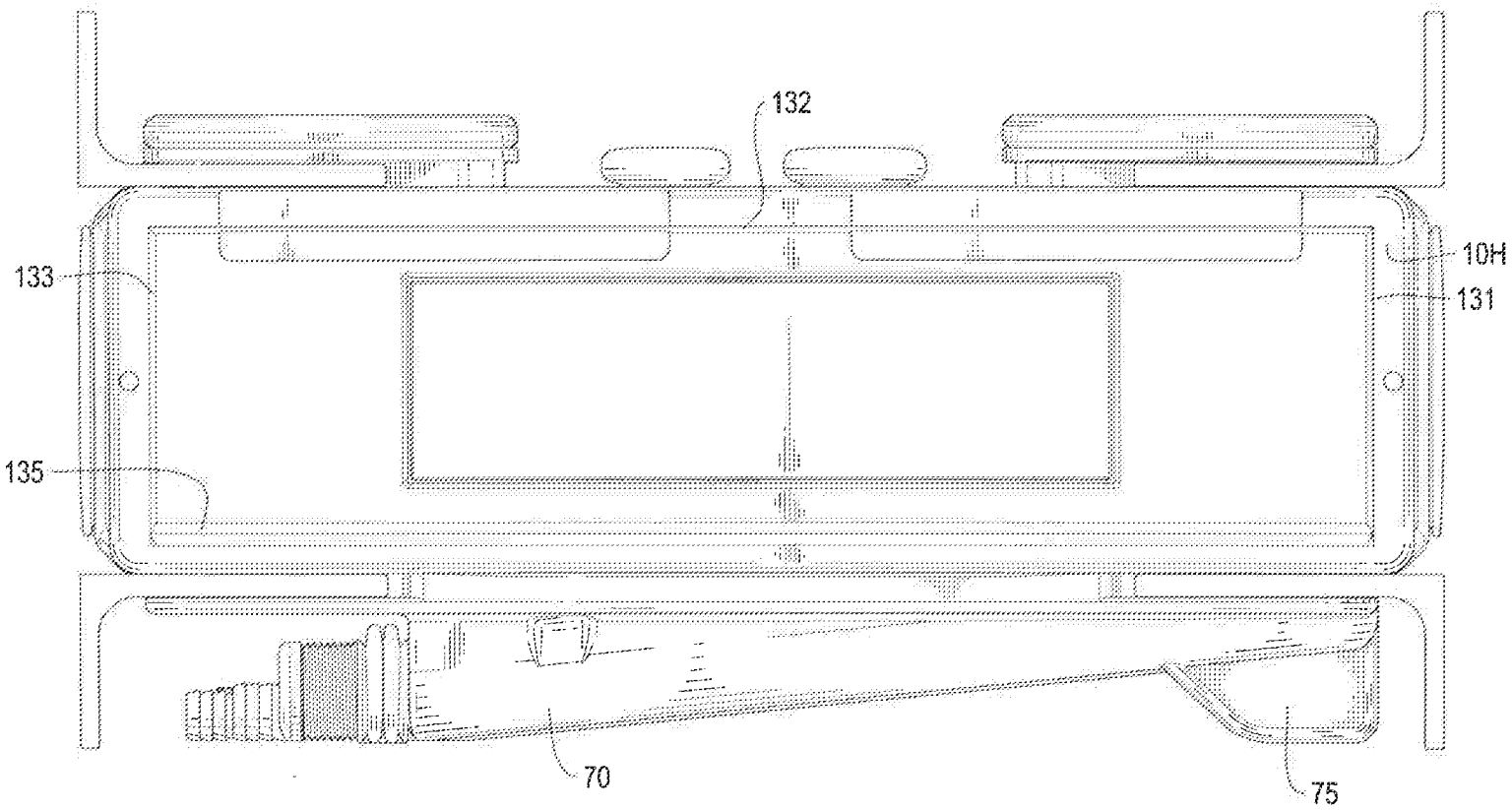
FIG. 6 is a rear elevational view of the rough-in box according to the first embodiment.
Figure 7:
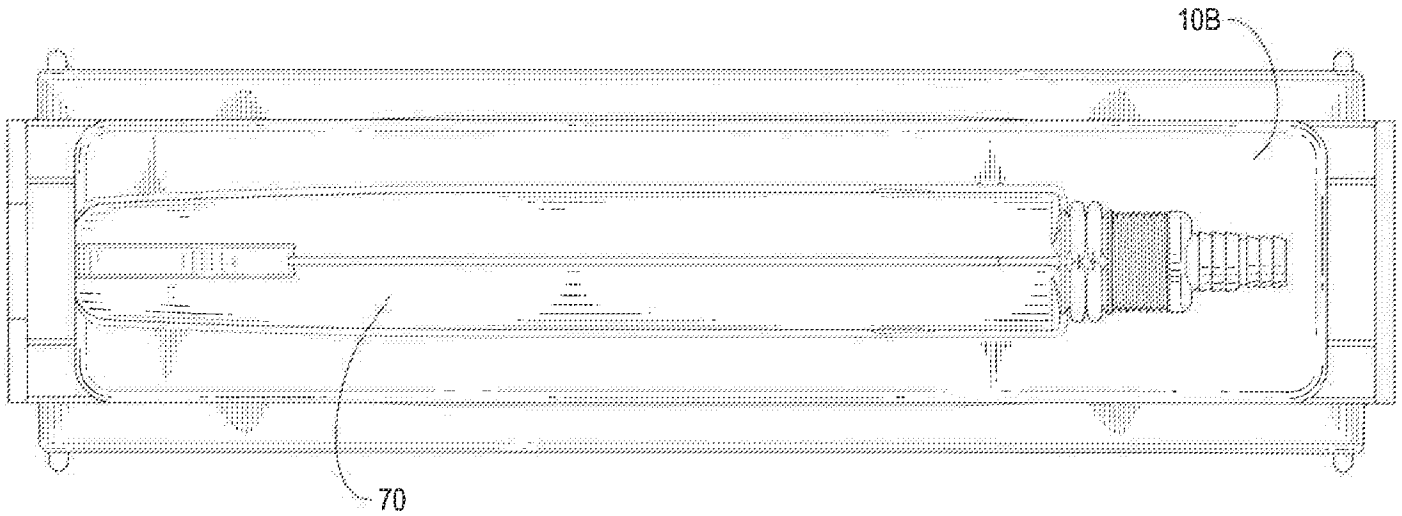
FIG. 7 is a bottom plan view of the rough-in box according to the first embodiment.

A first embodiment of a rough-in box for use with an air conditioner evaporator unit is now described in connection with FIGS. 1-12. FIG. 1 is a perspective view of a first embodiment rough-in box 1 seen from the top, left and front sides. FIG. 2 is a front view, FIG. 3 is a top view, FIGS. 4 and 5 are right and left views, respectively, FIG. 6 is a rear view is a rear view and FIG. 7 is a bottom view of the rough-in box 1 according to the first embodiment. As shown in these drawings, the rough-in box 1 includes a front wall 10F, a rear wall 10H, a top wall 10T, a bottom wall 10B, a left wall 10L and a right wall 10R. These walls enclose a chamber into which the lineset and power cables (and optionally a condensate pump) will be housed. Two small capped ports 50 and two large, capped ports 80 are provided in the top wall 10T. Left and right capped ports 60 optionally are provided on the left and right walls 10L, 10R. The caps of each port can be separate pieces that are, for example, pressure fitted onto the ports, or the caps can be integral with the box 1 and can be removed by cutting through cutting lines molded into the box between the ports and the caps.

One or both of the smaller ports 50 can be used to introduce a power cable into the box 1. Typically only one of the small ports 50 is used for a particular installation.

Typically one of the larger ports 80 is used for introduction of the lineset, which, as noted above, includes copper tubes surrounded by insulation.

The side ports 60 are optional, and typically are not used. However, certain installations may require that the lineset be introduced from the side, in which case one of the side ports 60 is used.

A rectangular-shaped cutting line is provided in the front wall 10F of the box 1. The cutting line includes an upper, horizontal cutting line 32, vertical right and left cutting lines 31, 33, and a lower, horizontal cutting line 35. The cutting lines 31, 32, 33 and 35 are formed as thinned portions of the front wall 10F. The lower cutting line 35 can be similar to the other cutting lines 31-33, or, as shown in FIG. 1, can include tapered (or chamfered) portions between the thin cutting line 35 and the thicker portion of the front wall 10F to facilitate use of the lower cutting line 35 as an integral hinge, to be described below.

In particular, and prior to installation of the sheet rock, three of the cutting lines, for example, lines 31, 32 and 33, are cut by the installer. This enables the faceplate 20 defined by the cutting lines 31-33 and 35 to be pivoted open about the integral hinge 35. This cutting and opening can occur before the rough-in box 1 is mounted with brackets 90 (to be discussed below) or after mounting with the brackets 90.

With the faceplate 20 in the open position, and with the appropriate ports 50, 60 and/or 80 having their caps removed, the installer can insert the power cable and lineset into the box 1 while easily viewing the arrangement of the power cable and lineset within the box 1. The faceplate 20 then can be closed and secured in the closed position, for example, with clips or other closure structure to be described below.

Two or four adjustable mounting brackets 90 can be provided for mounting the rough-in box 1 to studs of the building.

Figure 10:
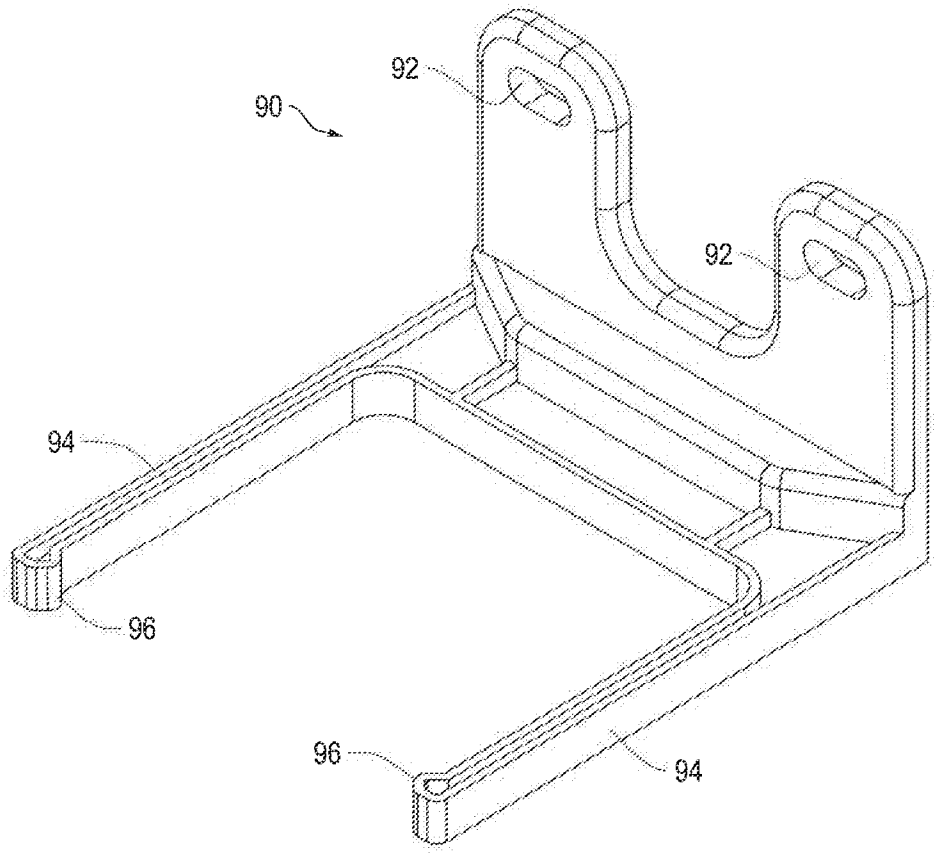
FIG. 10 is a perspective view of one of the mounting brackets.

In preferred embodiments, four adjustable mounting brackets 90 are provided. Each mounting bracket 90 includes holes 92 through which a fixing element such as a screw can be inserted in order to secure the mounting bracket to a wall stud. The mounting brackets 90 are adjustably attached to the rough-in box 1. One of the mounting brackets 90 is shown in FIG. 10. Each mounting bracket 90 includes a pair of arms 94, and at the end of each arm 94 is an inwardly-facing protrusion 96. The protrusion 96 mates with a notch 97 (see FIG. 12) provided on a surface 98 of the rough-in box 1. The surface 98 having the notch 97 can include a plurality of the notches 97 so that a plurality of different positions for the brackets 90 can be selected. The surfaces 98 on the top of the rough-in box 1 are provided at the front and rear of the large ports 80 provided through the top wall 10T of the rough-in box 1. Similar surfaces 98 with one or more notches 97 are provided at the front and rear on the left and right sides on the lower portion of the rough-in box 1. The brackets 90 preferably are made of a strong rigid plastic and thus the protrusion 96 will snap into one of the notches 97. It thus is unnecessary to provide the rough-in box in multiple widths. Rather, a single width rough-in box can be easily mounted between studs regardless of the distance between adjacent studs.

Figure 11:
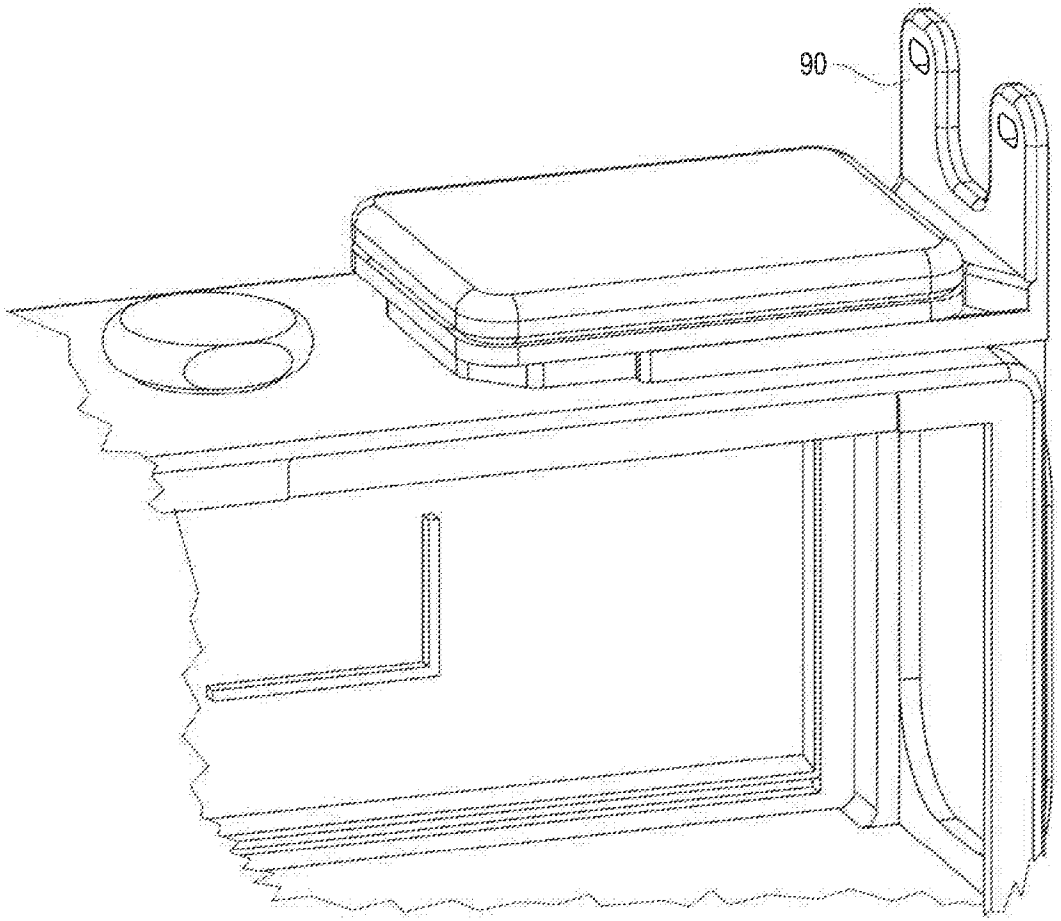
FIG. 11 is a partial, perspective view showing one of the mounting brackets in its most retracted position.
Figure 12:
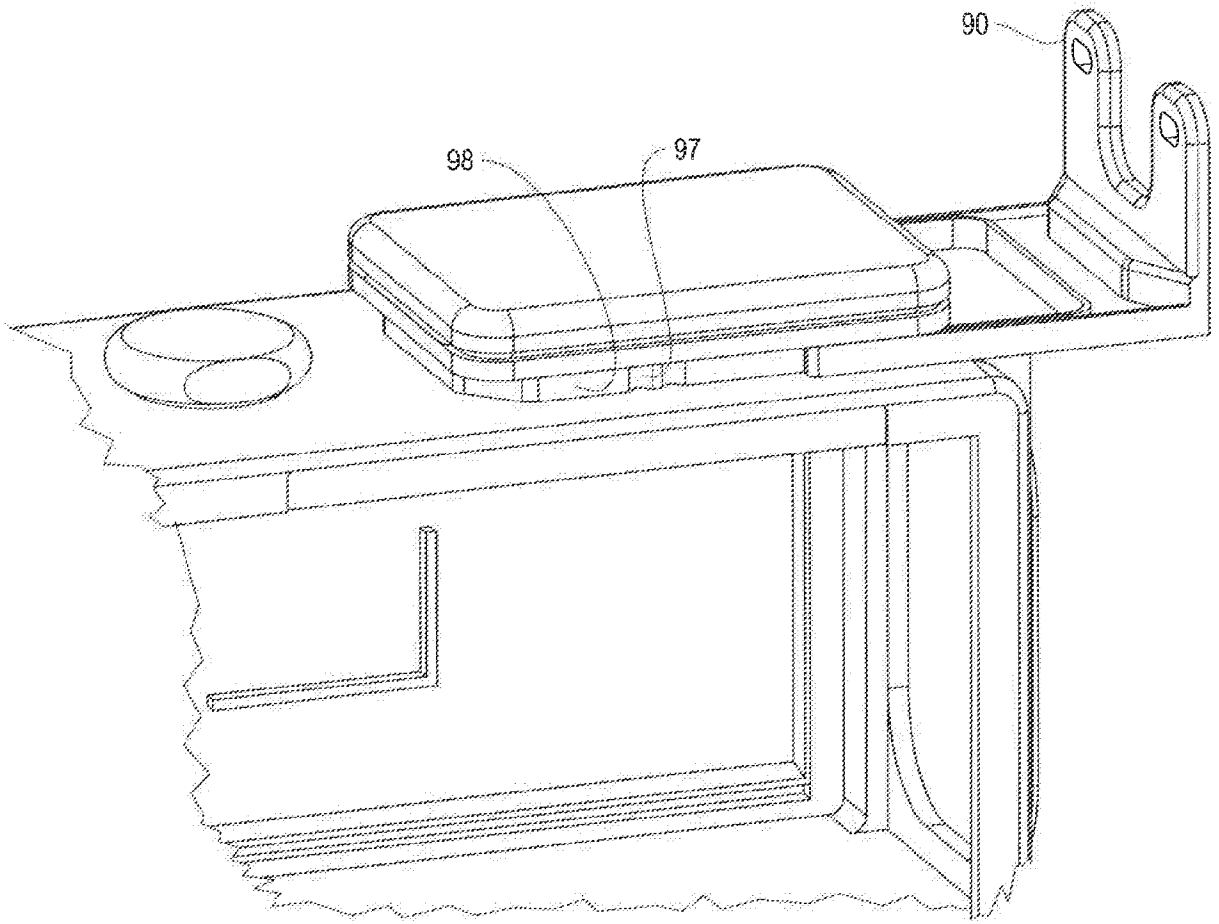
FIG. 12 is a partial, perspective view showing one of the mounting brackets in its extended position.

FIG. 11 shows one of the brackets 90 in the most-retracted position, whereas FIG. 12 shows one of the brackets 90 in an extended position.

Once the rough-in box has been mounted between two studs, the installer cuts the cutting lines 31, 32 and 33. The faceplate 20 then can be opened by pivoting about the integral hinge 35. The installer then determines which of the small ports 50 will be used and either removes the cap (if a removable cap is provided) of cuts off the cap to provide access to the inside of the rough-in box 1.

The installer also determines whether one of the large ports 80 on the top wall 10T will be used to receive the lineset, or whether one of the large side ports 60 will be used to receive the lineset. The cap of the selected port 80 or 60 then is removed, for example by cutting.

Figure 15:
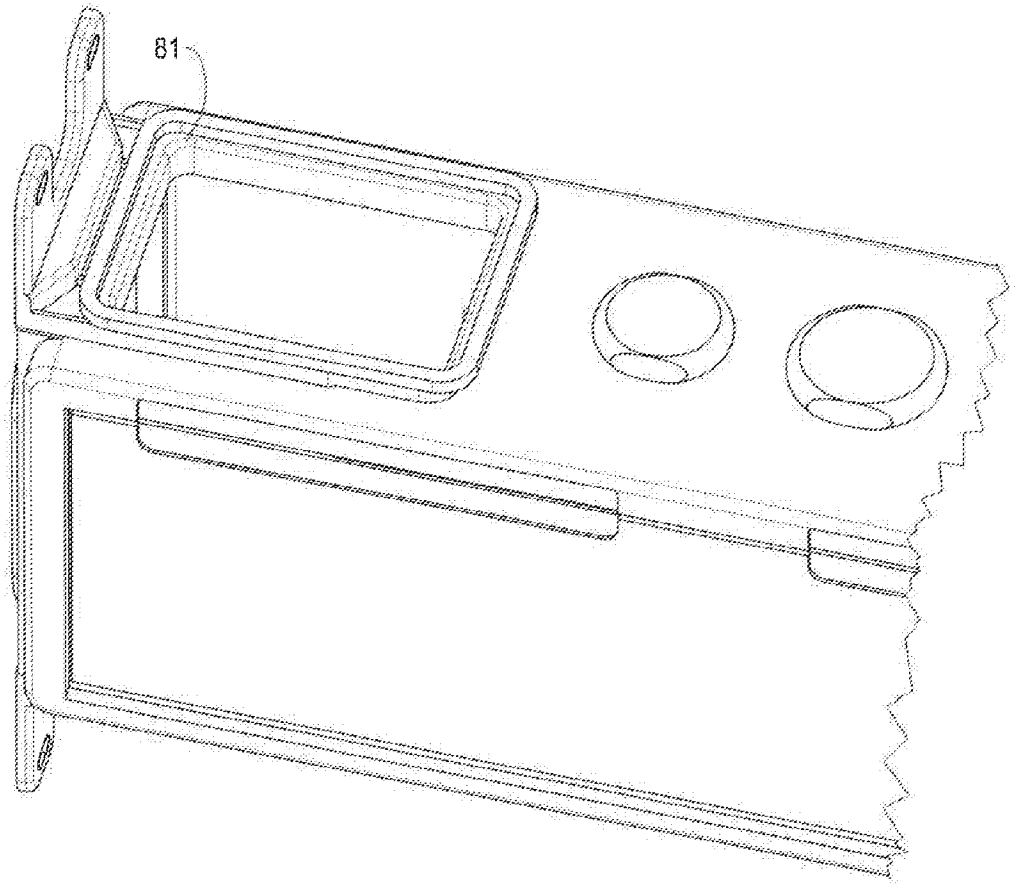
FIG. 15 is a partial perspective view showing one of the large ports in the top surface having rounded edges.
Figure 16:
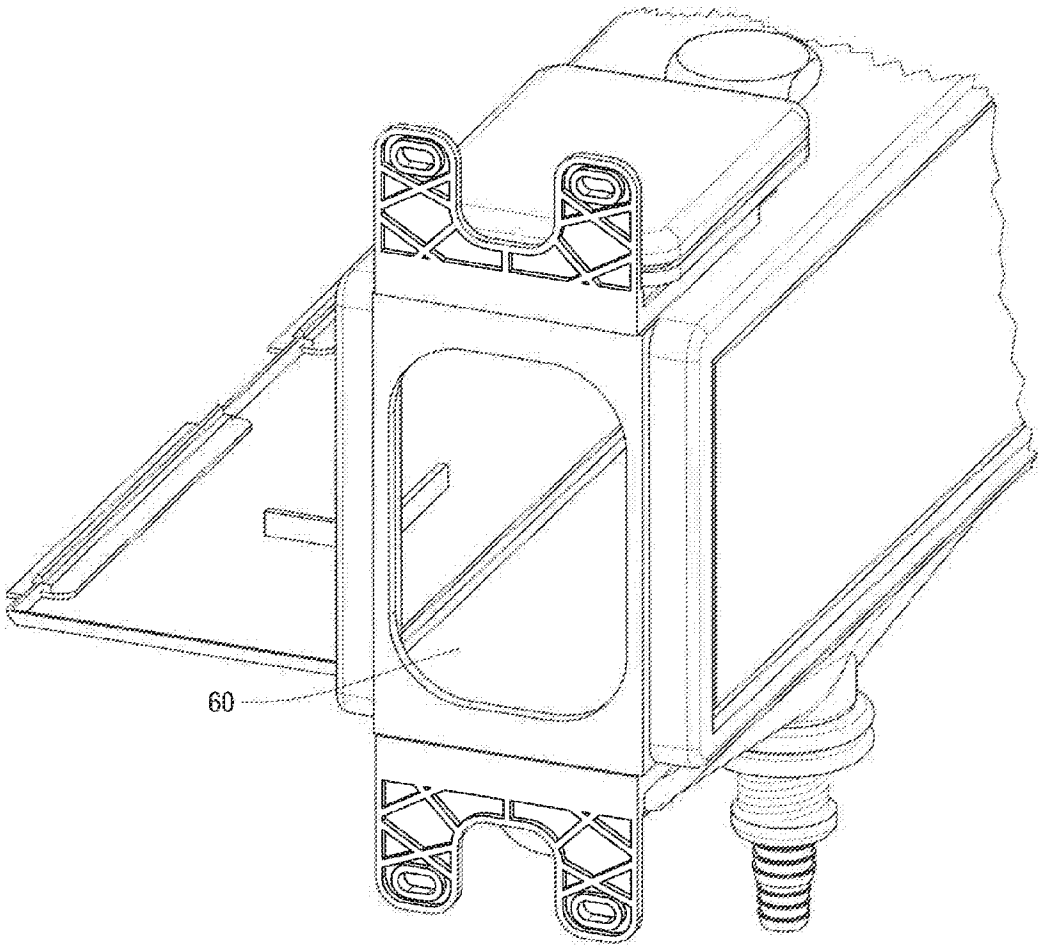
FIG. 16 is a partial perspective view showing one of side ports in the side surface having rounded edges.

Because the lineset consists of copper pipes having insulation, the insulation can be cut or otherwise damaged by the edge of the port particularly when the lineset is pulled or pushed into the rough-in box 1. Accordingly, the ports 60 and 80, which receive the lineset, have rounded lips to avoid cutting the insulation provided on the copper tubes of the lineset. This can be achieved by having the edge of the port protrude by about 0.125 inches outward of the top plate 10T or left or right plates 10L and 10R. The protruded port then is rounded so as to present a curved surface that will exist once the cap is removed. FIG. 15 shows one of the larger ports 80 having a rounded edge 81. Instead of forming the edge of ports 80 as a 90 degree intersection between a horizontal wall and a vertical wall, the edge 81 is rounded so as to smoothly transition from the horizontal wall to the vertical wall. FIG. 16 shows the rounded edges of the side port 60.

Once the cables and lineset have been placed into the rough-in box, the faceplate 20 is moved to the closed position and held in place by a closure. According to a preferred embodiment, the closure consists of one or more clips 45. The clips 45 are provided with the rough-in box 1 and can, for example, be located inside the box when it is delivered. The installer fastens the one or more clips 45 to an edge of the faceplate, for example, the edge adjacent to cutting line 32. When the faceplate 20 is moved to the closed position, the clips will engage with the portion of the front wall 10F above the cutting line 32 to hold the faceplate 20 in the closed position. Recesses 22 can be provided adjacent to the cutting line 32 on the faceplate in order to receive the clips. Similar recesses 38 can be provided on the portion of the front wall 10F above the cutting line 32 to receive the clips.

Figure 8:
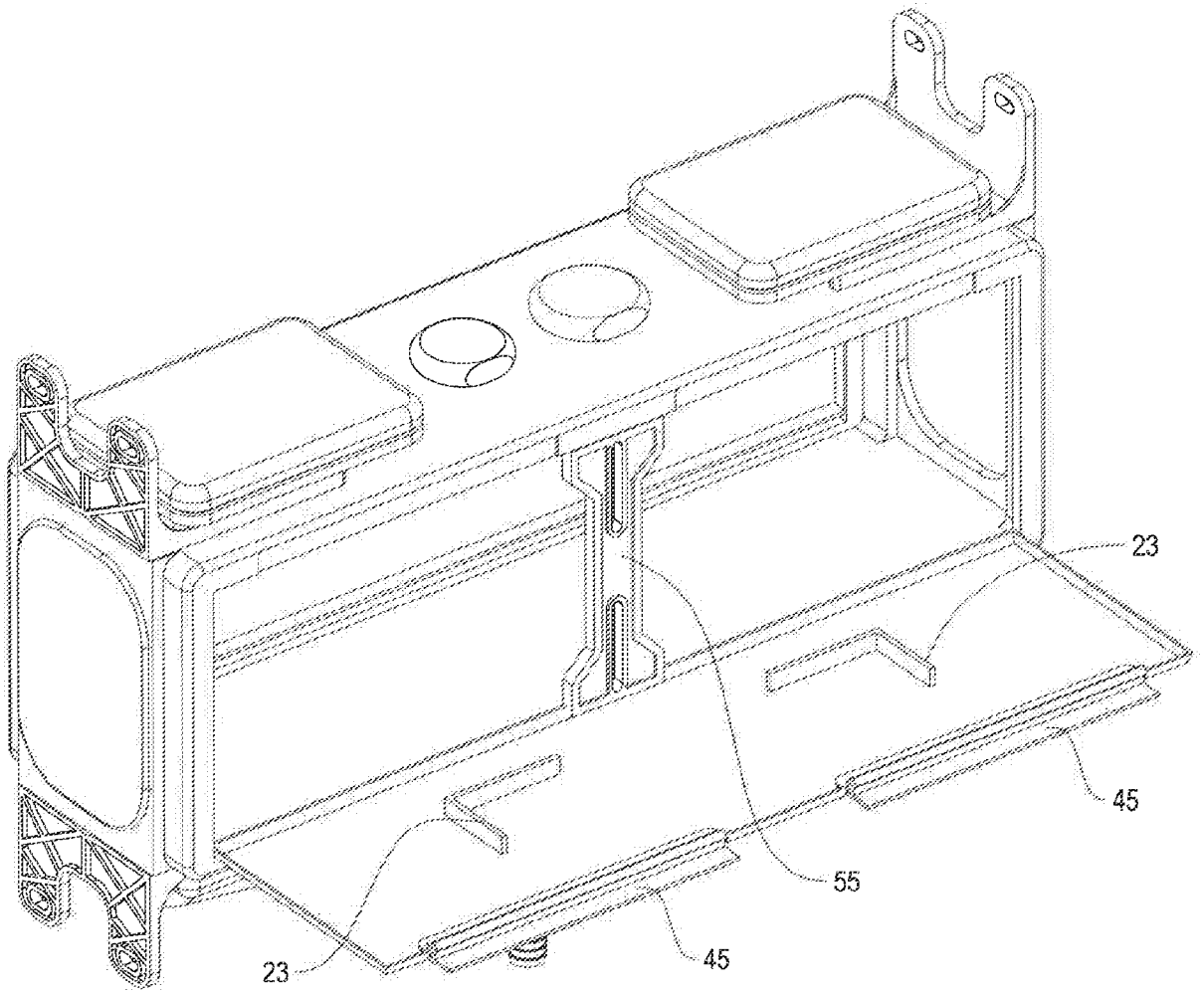
FIG. 8 is a front, top, left-side perspective view of the FIG. 1 rough-in box with the faceplate having been opened and showing clips installed on the opened faceplate and a reinforcing bracket installed in the opening.

FIG. 8 shows the clips 45 installed on the faceplate before closing the faceplate. The clips 45 are plastic pieces that can be friction fitted to the edge of the faceplate by the installer.

Figure 14:
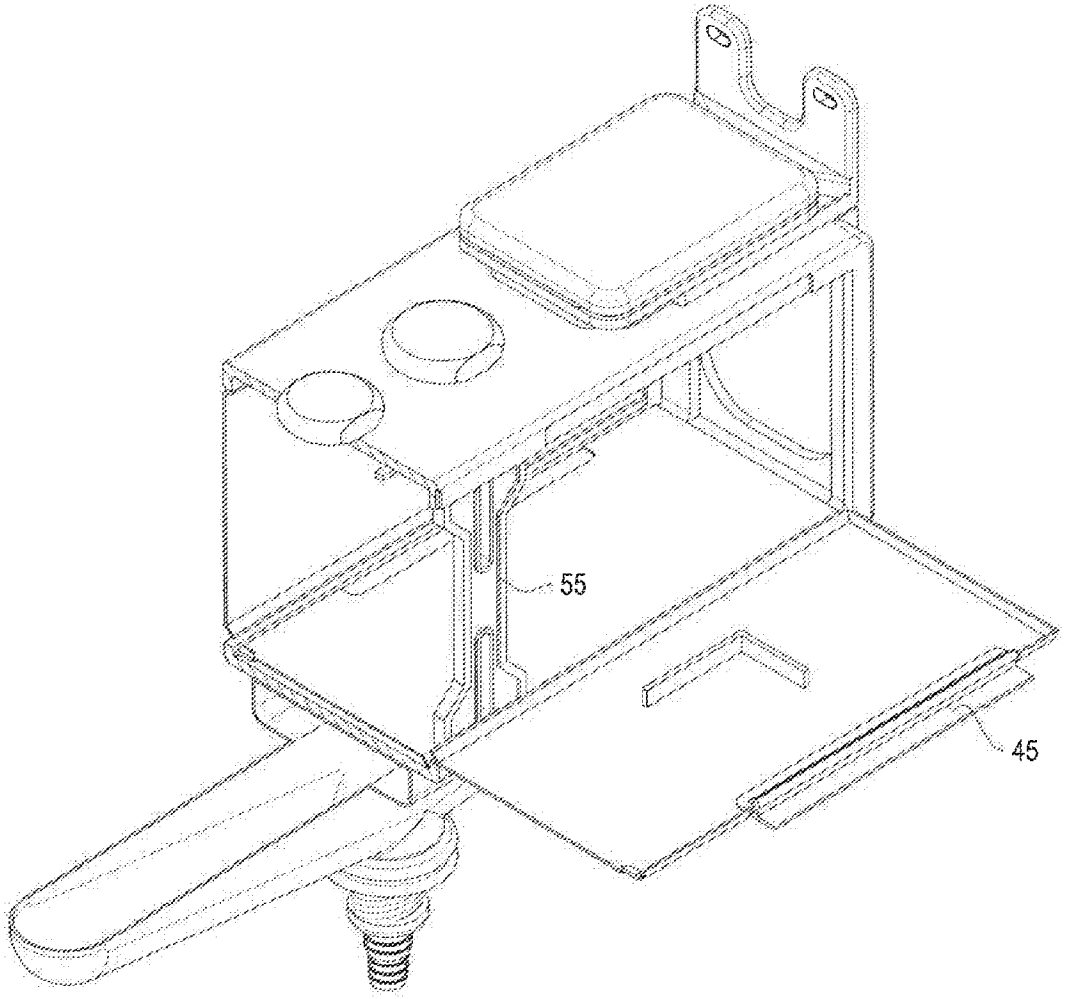
FIG. 14 is a partial perspective view similar to FIG. 8, and showing the manner in which the reinforcing bracket is attached to the rough-in box.

FIG. 8 also shows a reinforcing bracket 55 that is attached between the upper and lower edges of the opening formed by the open faceplate. The reinforcing bracket 55 rigidifies the rough-in box 1 to prevent vibration, which can occur when a condensate pump is installed within the box 1. FIG. 14 shows the manner in which the reinforcing bracket 55 is clipped into place above and below the opening formed when the faceplate 20 is open.

Figure 9:
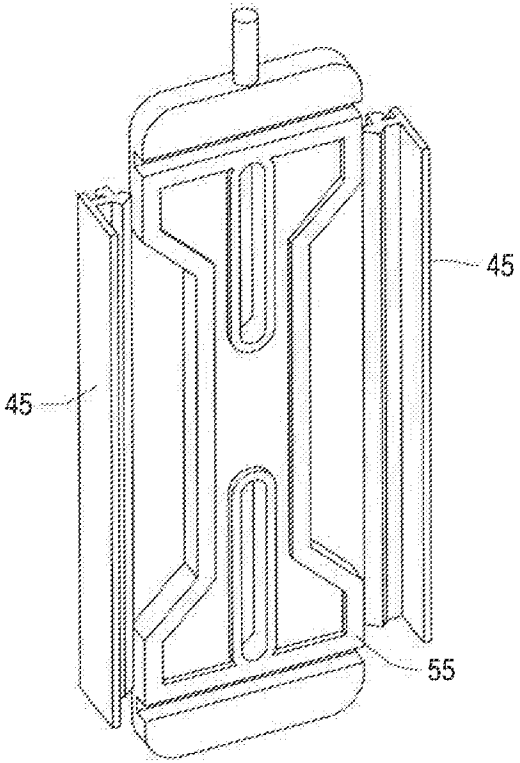
FIG. 9 shows the reinforcing bracket and faceplate clips molded as one part, and which is supplied with the rough-in box.

The reinforcing bracket 55 and the clips 45 can be molded as one piece as shown in FIG. 9. The installer then simply removes the clips 45 from the reinforcing bracket 55 before installing the reinforcing bracket 55 in place and installing the clips 45 on the faceplate 20.

After the faceplate 20 has been closed, the sheet rock installer installs the sheet rock. Because the portion of the front surface 10F extends by about 0.50 inches outward beyond the wall studs, it is easy for the sheet rock installer to cut an appropriate opening in the sheet rock so that the sheetrock surrounds the accessible part of the rough-in box 1. That is, after the sheet rock has been installed, one can see the front wall 10F (including the faceplate 20 in the closed position) through the hole that has been cut in the sheet rock.

Because the faceplate 20 is securely held in the closed position, no mud or other contaminants can enter the rough-in box during installation.

When it is time to install the evaporator, the faceplate 20 is completely removed, for example, by cutting through the integral hinge 35. The lineset and power cable then can be coupled to the appropriate couplings of the evaporator. The evaporator then is hung on the wall covering the opening in the sheetrock formed for the rough-in box 1.

Figure 18:
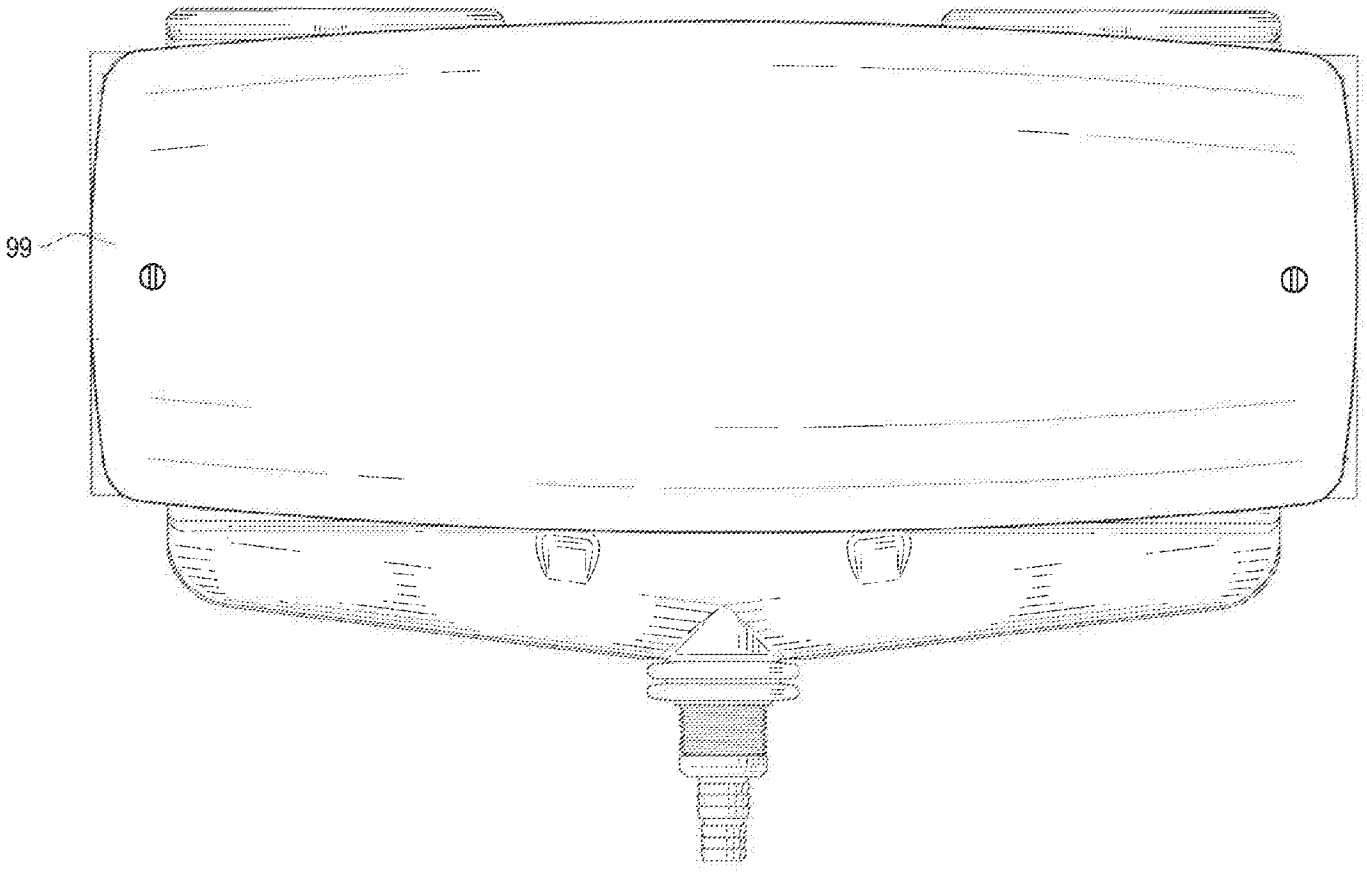
FIG. 18 is a perspective view showing a decorative faceplate attached to the rear surface of the rough-in box.

As shown in FIG. 6, cutting lines 131, 132, 133 and 135 are provided in the rear wall 10H. Cutting lines 131, 132, 133 and 135 are identical to cutting lines 31, 32, 33 and 35 on the front wall 10F. The rough-in box 1 thus can be installed with the drain outlet facing to the left or to the right. In addition, the cutting lines 131, 132, 133 and 135 can enable easy access to the inside of the rough-in box 1 from behind, for example, for maintenance (because the air conditioning unit having the evaporator covers the front side of the rough-in box 1, it may not be easy to access the inside of the rough-in box 1 for maintenance after installation of the air conditioner). By cutting a corresponding hole in the sheetrock on the other side of the wall, and cutting through the cutting lines 131, 132, 133 and 135 on the rear wall 10H, an opening will be produced which will permit access from the rear to the components inside of the box 1. When not in use (that is, after the box has been accessed from the rear and the repairs, etc. are made), the hole can be covered by a decorative faceplate 99 (see FIG. 18) which may be supplied separately. In the event that no rear access is required, this option can be left unused (that is, the thinned cutting lines 131-133 and 135 are not cut), and, in the event that it is not utilized during initial installation and rear access becomes desirable at a later date, it can easily be accessed.

Figure 21:
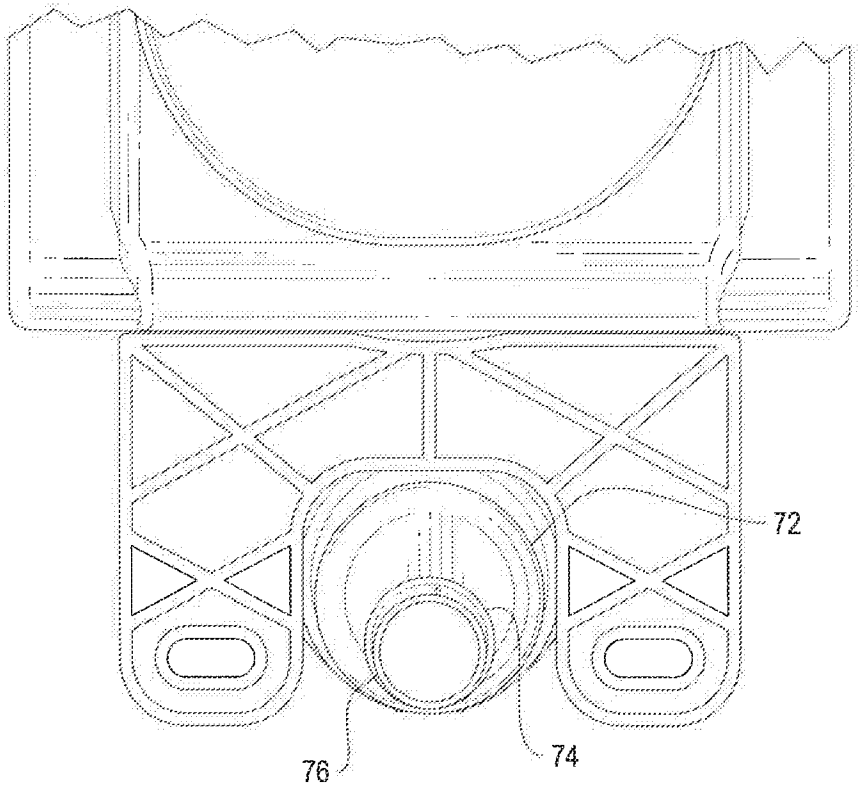
FIG. 21 is a view looking into the drain outlet and showing the non-concentric couplings.

In a typical installation, condensate from the evaporator flows into the rough-in box and flows downward into sump 70. As shown, for example, in FIG. 2 and FIG. 21, the sump 70 has a drain outlet 71 with three different types/sizes of couplings 72, 74 and 76. The first coupling 72 is a threaded coupling that can be connected to a mating threaded coupling of a hose. The second coupling 74 is a large press fit coupling that can be coupled to an open tube having an inner diameter of, for example, 16 mm. The third coupling 76 is similar to the second coupling 74 but has a smaller diameter suitable for press fit coupling with an open tube having an inner diameter of, for example, 14 mm. If the first coupling 72 is used, the installer can simply remove (by cutting) the second and third couplings 74, 76. If the second coupling 74 is used, the installer can remove (for example, by cutting) the third coupling 76. As can be seen from FIG. 2 and FIG. 21, the couplings 72, 74 and 76 are not concentric, but rather are asymmetrical so that liquid will not be trapped within the outlet 70. In particular, the lowest inner surfaces of couplings 76, 74 and 72 are substantially at the same level (i.e., define a continuous surface). In addition, the lowest inner surfaces of the couplings 72, 74, 76 are at the same level as the lowest inner surface of the inside of sump 70. Liquid thus will not be trapped in the sump 70 or within any of the couplings 72, 74, 76.

The outer portion of the sump 70 also includes a leveling fin 75. The lowest surface of the leveling fin 75 is at the same position as the lowest surface of the couplings 72, 74, 76 such that the installer can place a level against the lowest surface of the fin 75 and the lowest surface of the couplings 72, 74, 76 to ensure that the rough-in box 1 is mounted in a level position (or, perhaps, mounted so that flow will be downward toward the couplings 72, 74, 76).

Figure 19:
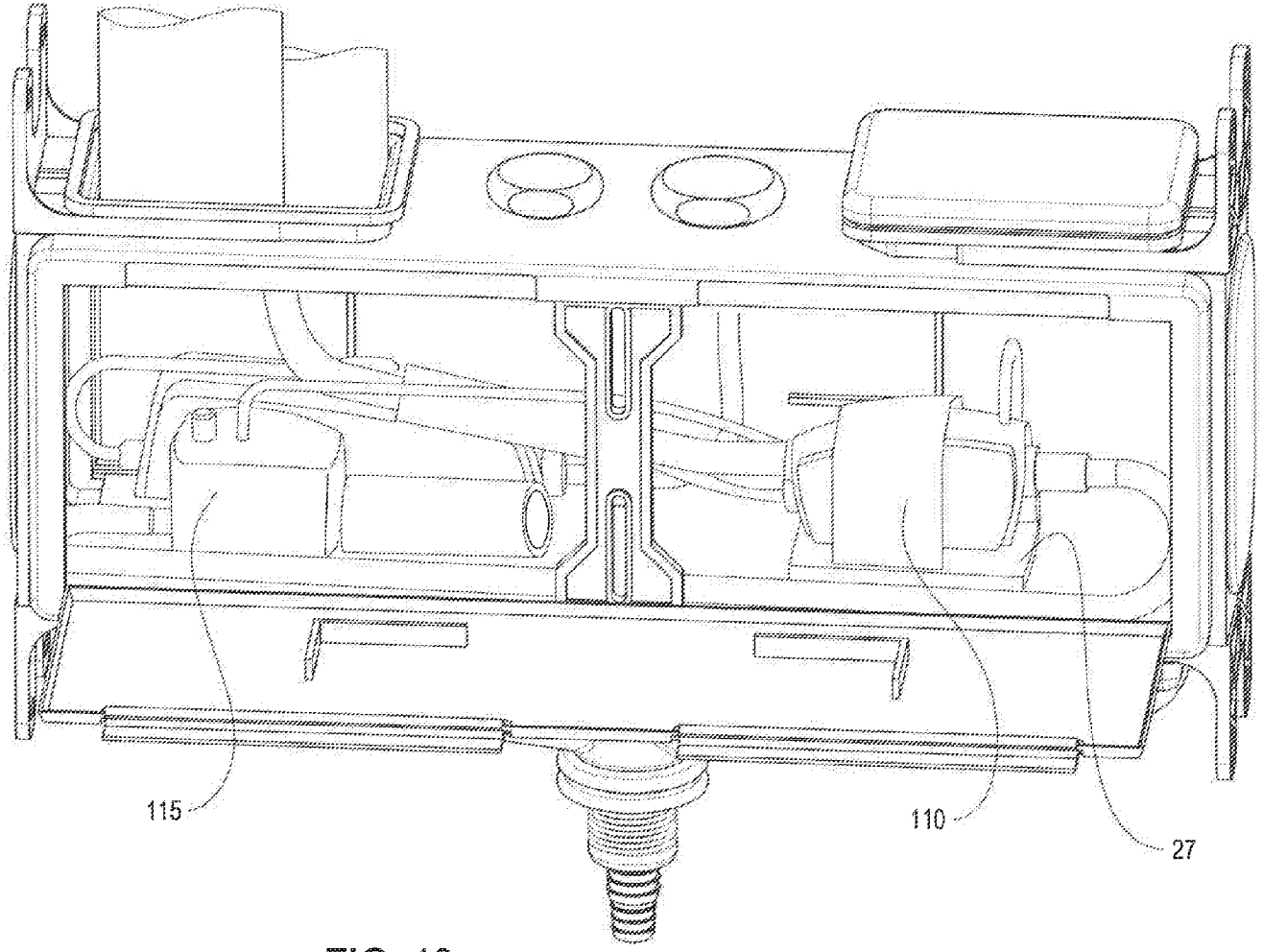
FIG. 19 is a perspective view of the second embodiment rough-in box with the lineset, electrical cable and condensate pump installed.
Figure 20:
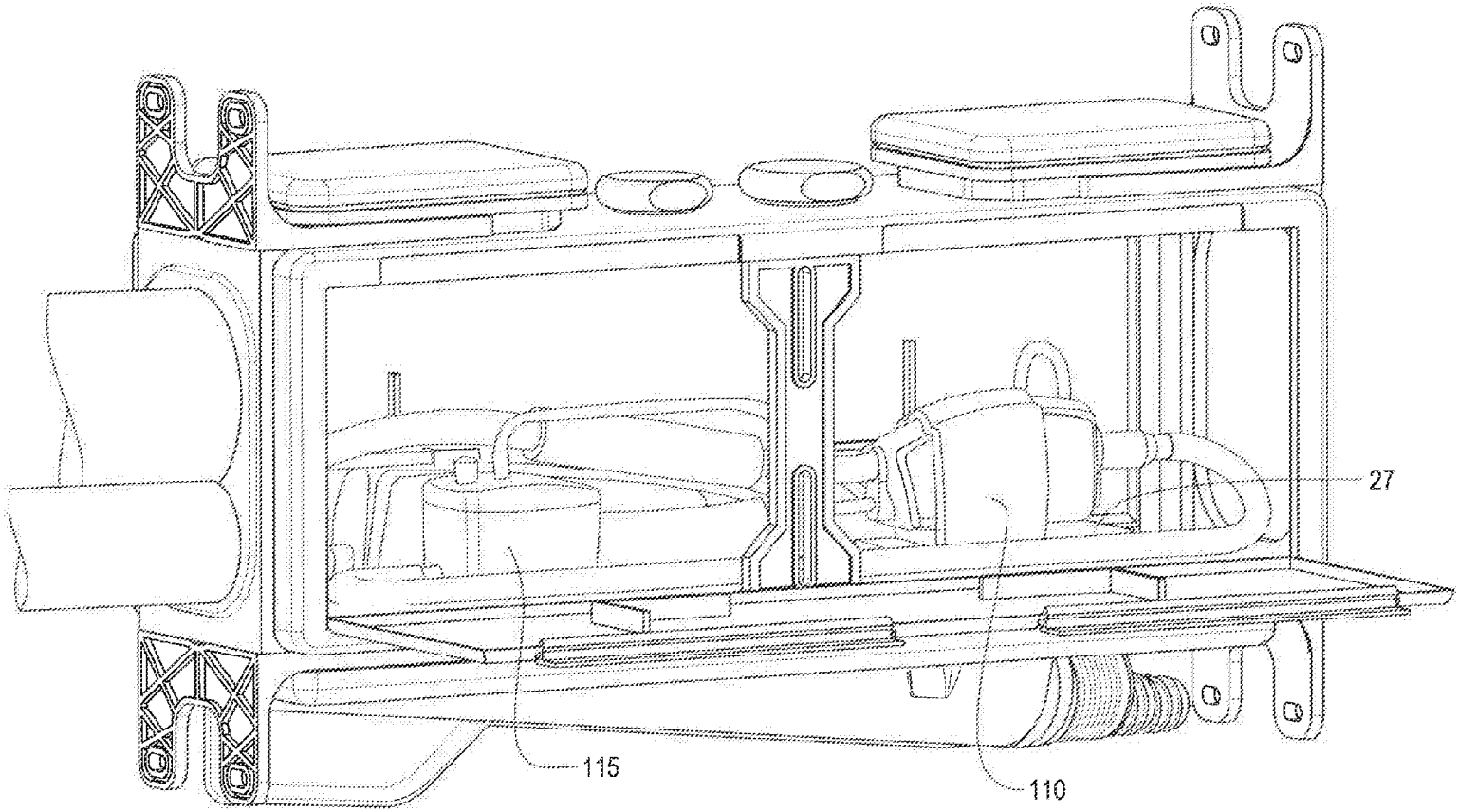
FIG. 20 is a perspective view of the first embodiment rough-in box with the lineset, electrical cable and condensate pump installed.

Although a condensate drainage pipe system (relying on gravity to cause the condensate liquid to flow from the sump 70) typically is installed for an air conditioning system, in approximately 10 to 15% of installations, the use of condensate drainage pipe systems is not possible (for example, if the liquid must flow upward to exit the rough-in box), and in these case, a separate aftermarket condensate pump has to be used. To facilitate the use of a condensate pump, the rough-in box 1 includes a flat plate to be clipped into the box at a point above the sloped drainage sump 70, thus providing a stable base on which to mount the reservoir of a condensate pump, as well as, if required, the actual pump mechanism, which is often a separate component, although it can also be a Monobloc type, i.e., a single mechanism. Further, the faceplate 20 of the box, which is removed when the air conditioner is installed, may be cut to size and clipped into position inside the box 1 to provide a base for the pump and/or reservoir assembly, thus eliminating the need for the installer to fabricate a separate mounting plate. The base is further designed with reinforcing strips included in it to provide a very stable base for the pump/reservoir which will prevent any vibration which can result in a noise within the conditioned space. This feature may be left unused if a more substantial mounting base is required in which case the installer would acquire a mounting base made from a heavier material. FIG. 8 shows reinforcing strips 23 that can be provided on the faceplate 20. FIGS. 19 and 20 show two different installations, each having a condensate pump 110 and reservoir 115 mounted on a mounting base plate 27 that is removably installed in the box 1.

Figure 13:
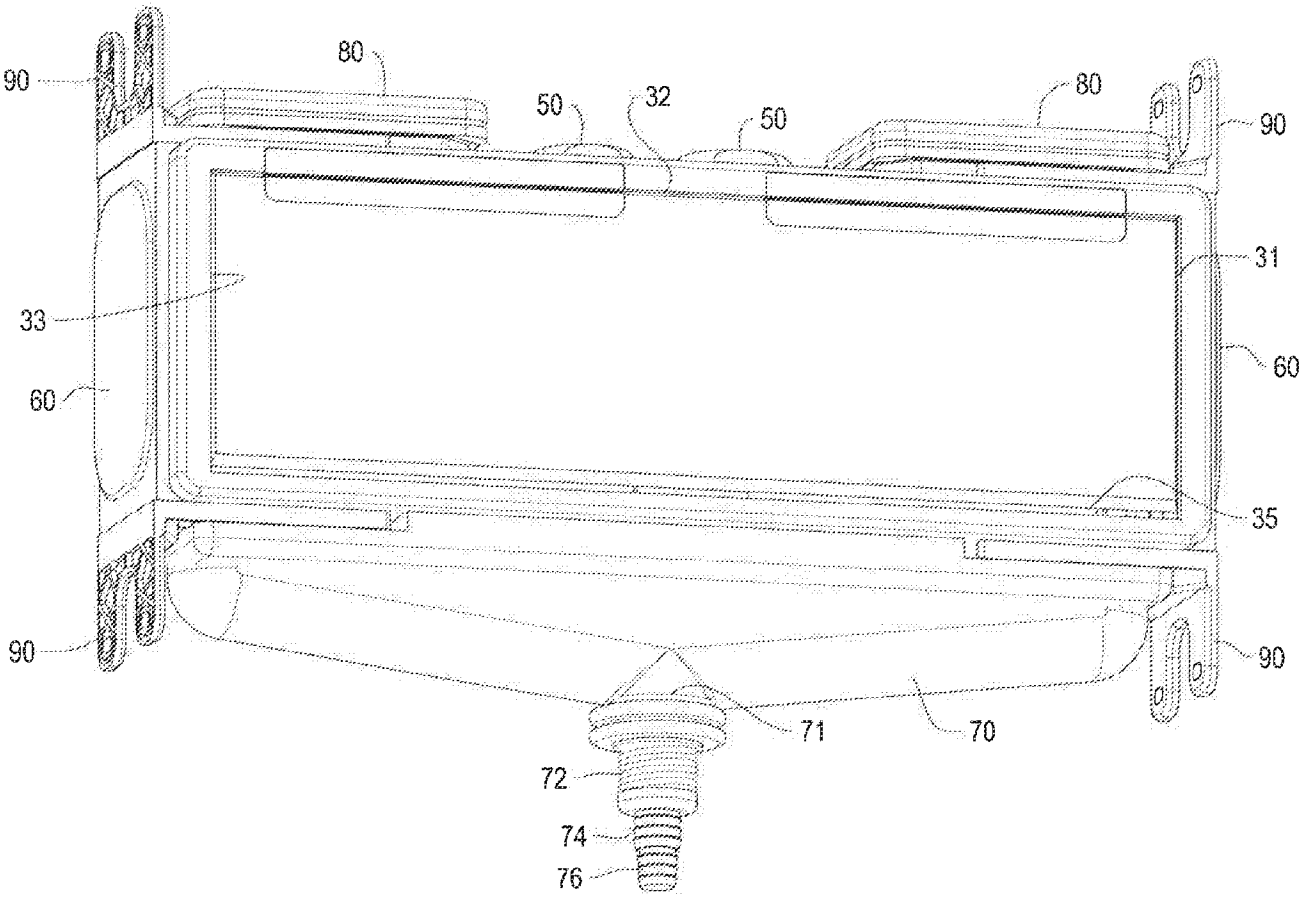
FIG. 13 is a front, bottom, left-side perspective view of a second embodiment rough-in box.

FIG. 13 shows a second embodiment that is similar to the first embodiment in all respects except for the shape of the sump 70 and the position and orientation of the drain outlet 71 (and associated couplings 72, 74 and 76). In particular, the drain outlet is located at a center of the lower end of the rough-in box 1 and extends downward.

Figure 17:
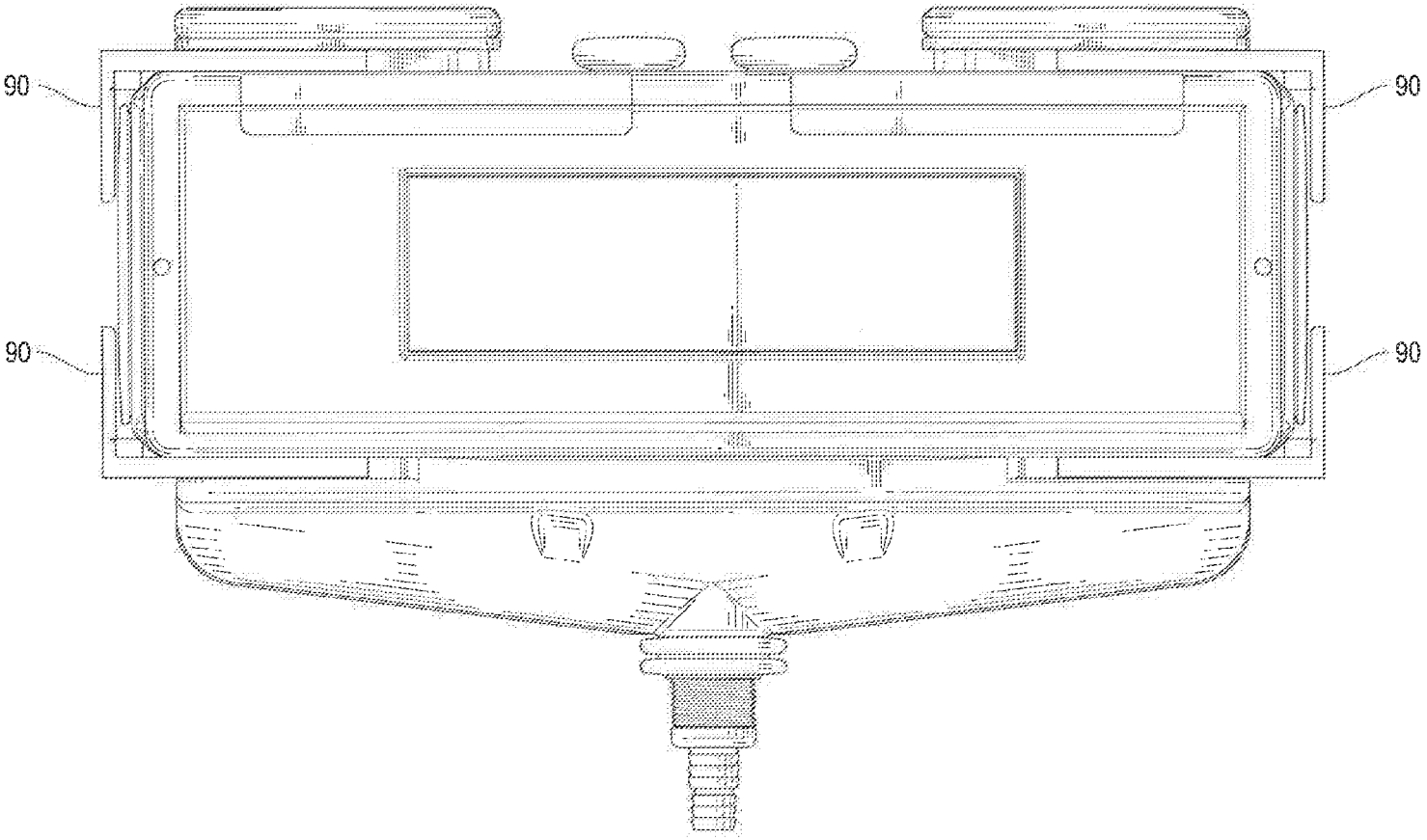
FIG. 17 is a front elevational view of the second embodiment and shows the orientation of the brackets when the rough-in box is shipped/stored.

FIG. 17 is a front elevational view of the second embodiment and shows the orientation of the brackets 90 when the rough-in box is shipped/stored.

Figure 22:
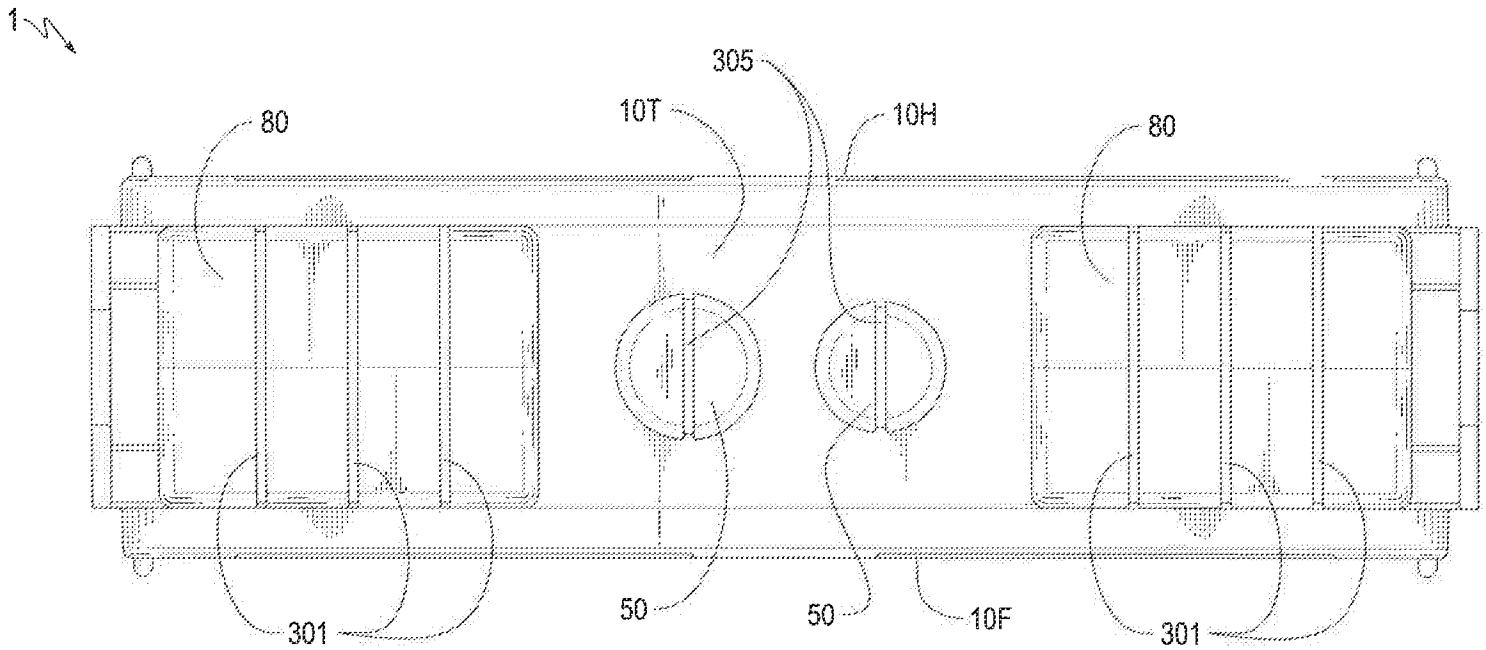
FIG. 22 is a top plan view of a rough-in box and shows examples of some modifications to the covers of the lineset ports and the covers of the power cable ports.

FIG. 22 shows examples of some modifications to the covers of the lineset ports and the covers of the power cable ports. As shown in FIG. 22, which is a modified version of FIG. 3, score lines 301 can be included in the caps of the large ports 80 that receive the lineset, and score lines 305 can be included in the caps of the small ports 50 that receive the power cable. The score lines 301 and 305 are portions of the covers that have a thinner thickness than the remainder of the covers. The score lines 301 make it easier for the installer to remove only a portion of the cover of the lineset ports 80 so that the opening is as small as possible. This reduces the amount of debris (contamination) that enters the box. The installer can simply cut the score lines 305 without removing any portion of the cap for the ports 50 that receive the power cable. The power cable simply can be pushed through the cap that has been cut through the score line 305 and the cap itself will tightly engage the cable to hold the cable in place. The score lines 301 can be provided in different locations than those shown in FIG. 22, and can be provided on the caps of the other lineset-receiving ports (for example, ports 60). The score lines 305 can be in the shape of an X or a cross instead of a straight (or broken) line.

Figure 23:
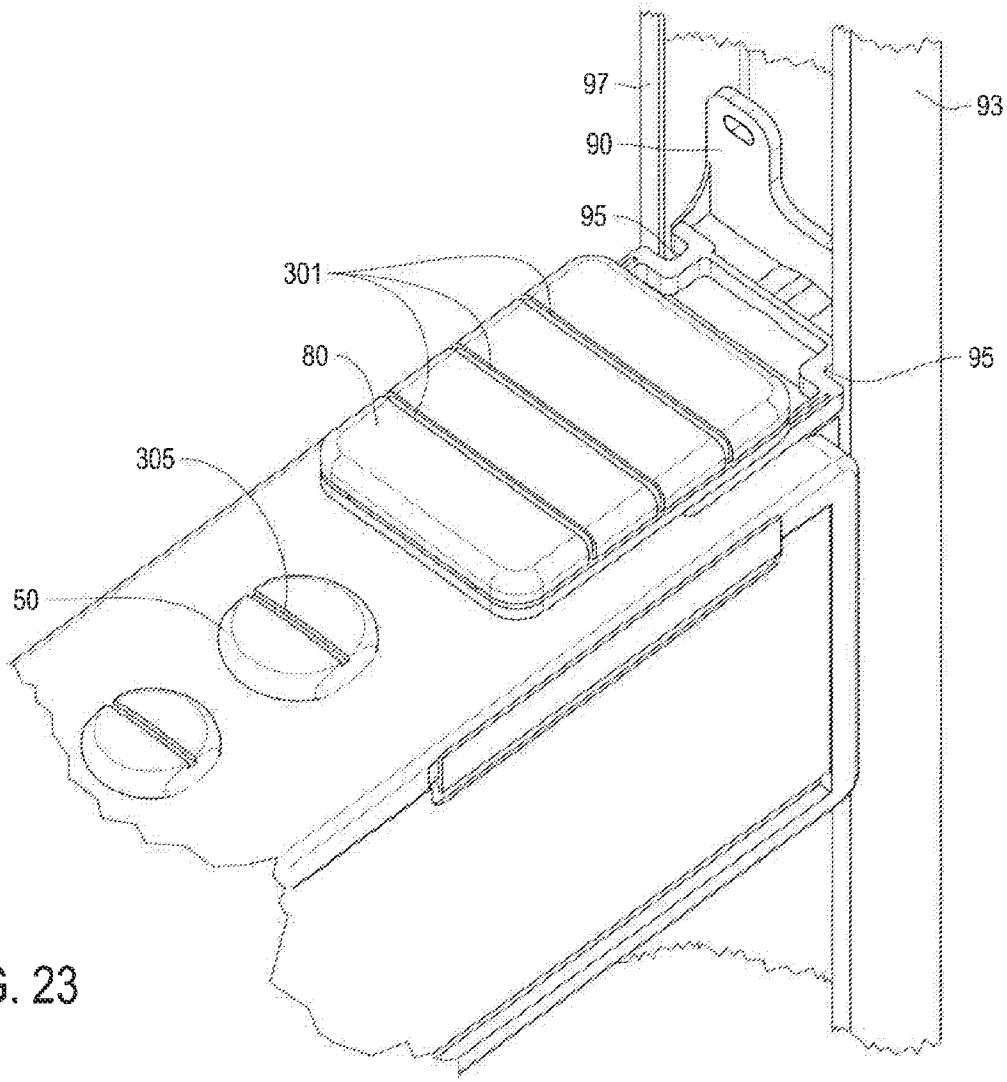
FIG. 23 is a perspective view showing a modified bracket in which notches are provided in the arms of the bracket.

FIG. 23 shows a modified bracket 90 in which notches 95 are provided in the arms 94 of the bracket 90. The notches 95 extend inwardly (reducing the width of the bracket at the location of the notches 95) to receive the flange 97 that is present on metal studs 93. The notches 95 thus prevent the arms 94 of the bracket 90 from interfering with the flange 97 on metal studs 93 when the side of the metal stud 93 having the recess (the non-flat side) faces the rough-in box.

Figure 24B:
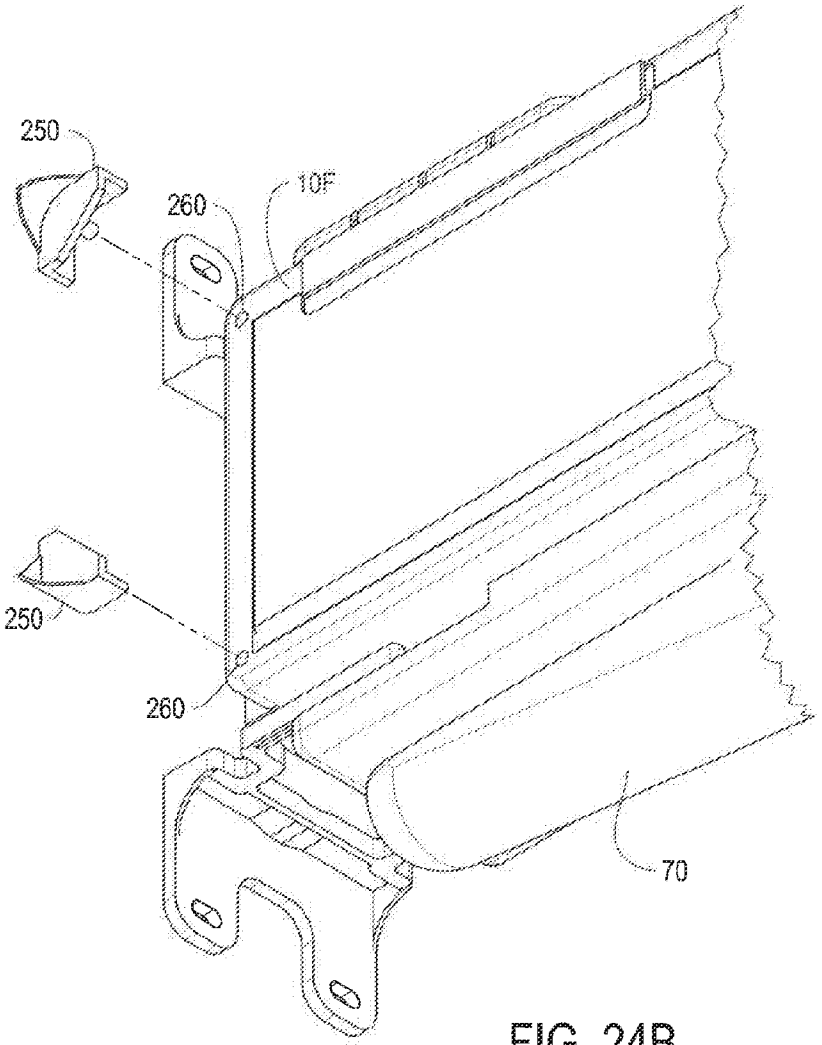
FIGS. 24A and 24B are perspective views showing marking pins that can be provided with the rough-in box to aid in its installation.
Figure 24A:
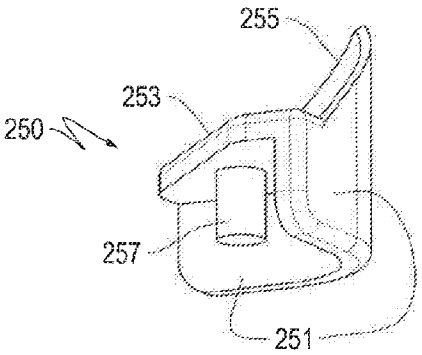

FIGS. 24A and 24B show marking pins 250 that can be provided with the rough-in box to aid in its installation. As shown in FIG. 24A, each marking pin 250 can be made of plastic or metal, and includes two perpendicular side walls 251, a top wall 253 that interconnects the side walls 251, a sharp marking portion (or wall) 255 that protrudes upwardly from a top surface of the top wall 253, and a fixing pin 257 that protrudes downwardly from a bottom surface of the top wall 253. As shown in FIG. 24B, each of the four front corners of the front surface of the rough-in box (only two corners are shown in FIG. 24B) includes a hole 260. The fixing pin 257 is inserted into the hole 260 to secure the marking pin 250 to a corner of the rough-in box before the sheetrock is installed over the box. The marking portion 255 of each of the marking pins 250 will penetrate and thus mark the sheetrock so that the installer can easily locate the mounted rough-in box and cut an appropriate hole through the sheetrock to access the rough-in box. The marking pins 250 can be removed after the hole has been cut through the sheetrock. Four of the marking pins 250 can be provided with the rough-in box, for example, by being placed inside of the rough-in box when the rough-in box is shipped.

In the embodiments described thus far, the condensate line of the air-conditioning (AC) unit terminates within the rough-in box and the condensate exiting the condensate line flows into the sump 70. A drain line then is attached to the drain outlet 71 of the sump 70 so that the liquid in the sump can be directed to outside of the building, for example. Such an arrangement potentially has some issues. One issue is that certain building codes may prohibit the collection of liquid within a rough-in box (although with many installations there will be no exposed electrical wires within the rough-in box). Another issue is that the condensate line clog detector of the AC unit will not be able to detect clogging of the drain line that is connected to the drain outlet 71 because that drain line is separated from the AC unit condensate line by the sump 70. These issues can be addressed by providing a coupling that is placed inside the rough-in box and by which the condensate line of the AC unit is directly attached to the drain line that exits the rough-in box. Such a modification is described below in connection with FIGS. 25A, 25B, 26A and 26B.

Figure 25B:
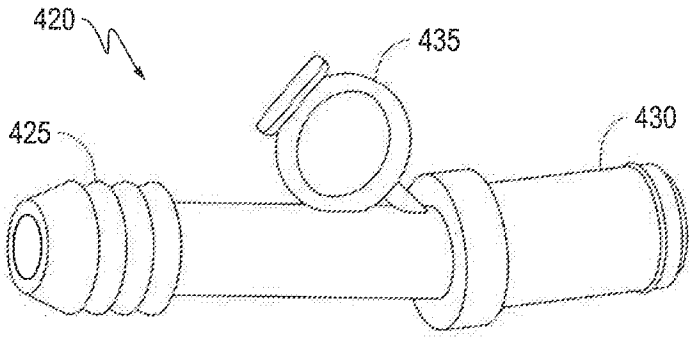
FIGS. 25A and 25B show two examples of couplings that can be used to couple the AC unit condensate line to the drain line of the building.
Figure 25A:
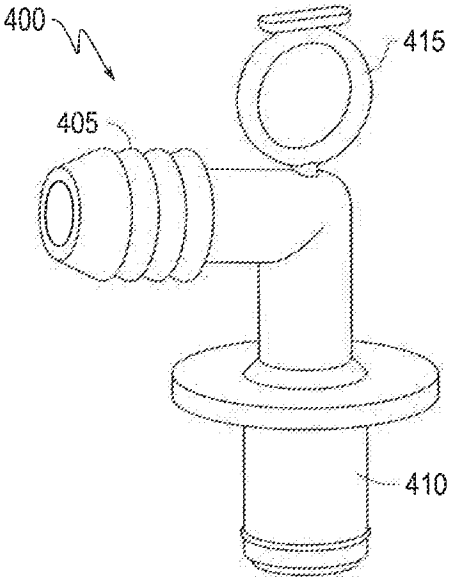

FIGS. 25A and 25B show two examples of couplings that can be used to couple the AC unit condensate line to the drain line of the building. The couplings are hollow tubular members preferably made of plastic and/or rubber or a combination of both. The coupling 400 of FIG. 25A is L-shaped and can be used in the rough-in box of FIGS. 13 and 16-19 having a downward extending drain outlet 71. The coupling 400 includes an L-shaped body, a first end 405 that is removably attached to the AC unit condensate line within the rough-in box, second end 410 that is coupled directly or via another coupling to the drain line of the building, and optionally a ring-shaped handle 415 to facilitate handling of the coupling 400. The coupling 420 of FIG. 25B is substantially straight (it is bent slightly) and can be used in the rough-in box of FIGS. 1, 2, 6, 20 and 21 having a sideward extending drain outlet 71. The coupling 420 includes a substantially straight body, a first end 425 that is removably attached to the AC unit condensate line within the rough-in box, second end 430 that is coupled directly or via another coupling to the drain line of the building, and optionally a ring-shaped handle 435 to facilitate handling of the coupling 420.

Figure 26A:
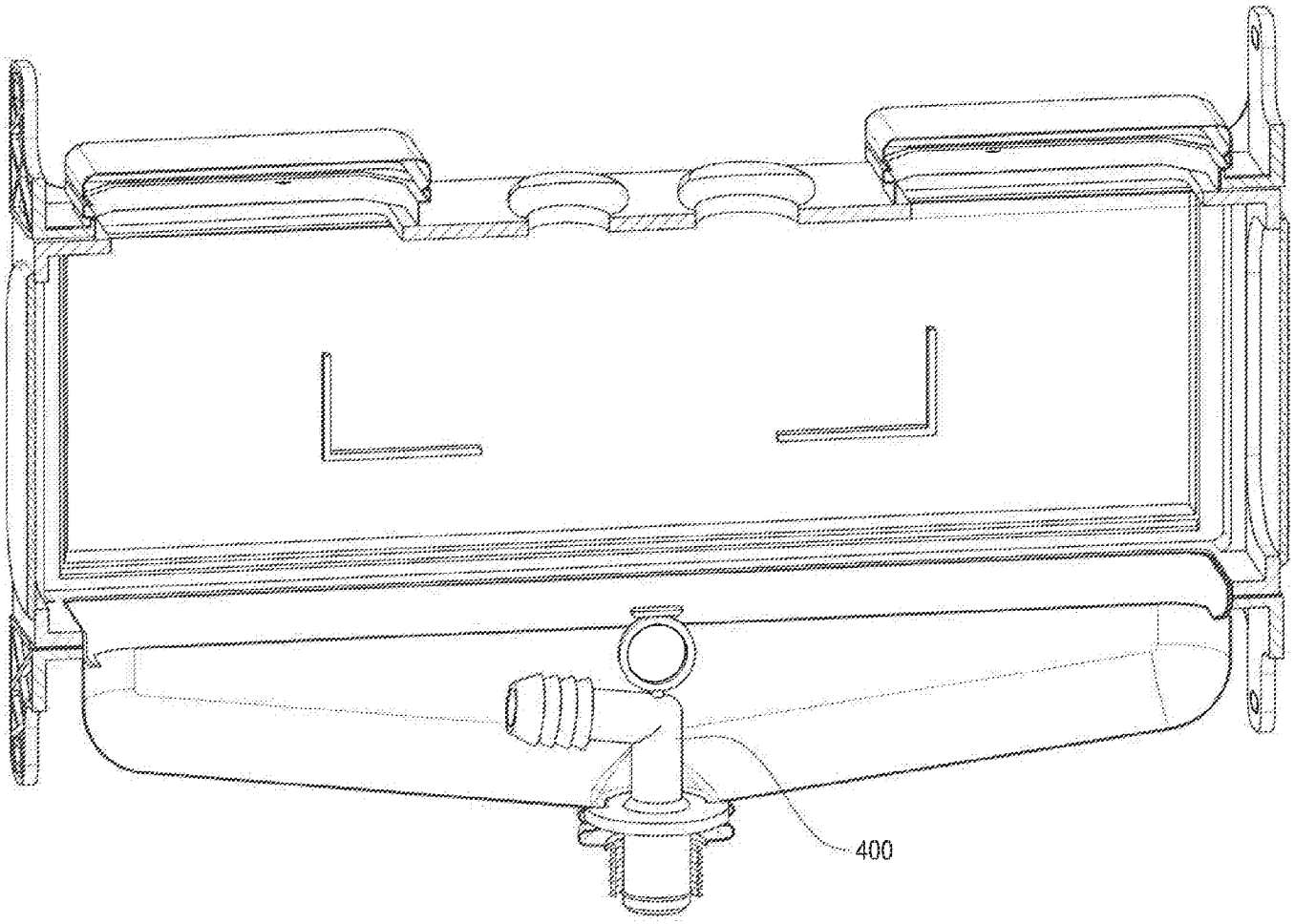
FIGS. 26A and 26B show the couplings of FIGS. 25A and 25B installed in their respective rough-in boxes.
Figure 26B:
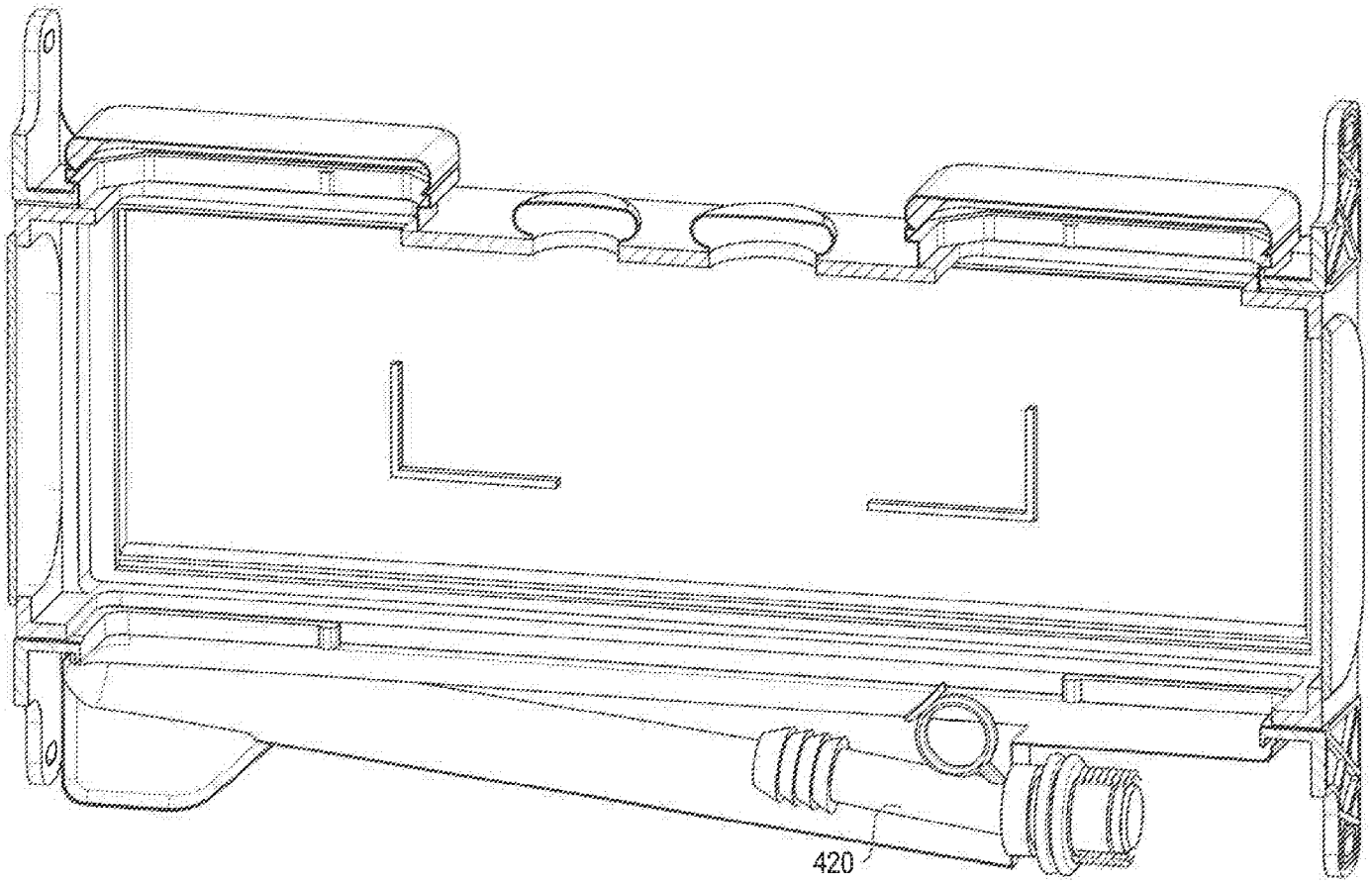

FIGS. 26A and 26B show the couplings 400 and 420 installed in their respective rough-in boxes. When the couplings 400 or 420 are provided with the rough-in box, the rough-in box does not need to have a drain outlet with the coupling structure 72,74,76 shown in FIGS. 13 and 21. Rather a simple opening can be provided through which the coupling 400 or 420 will extend.

Figure 27:
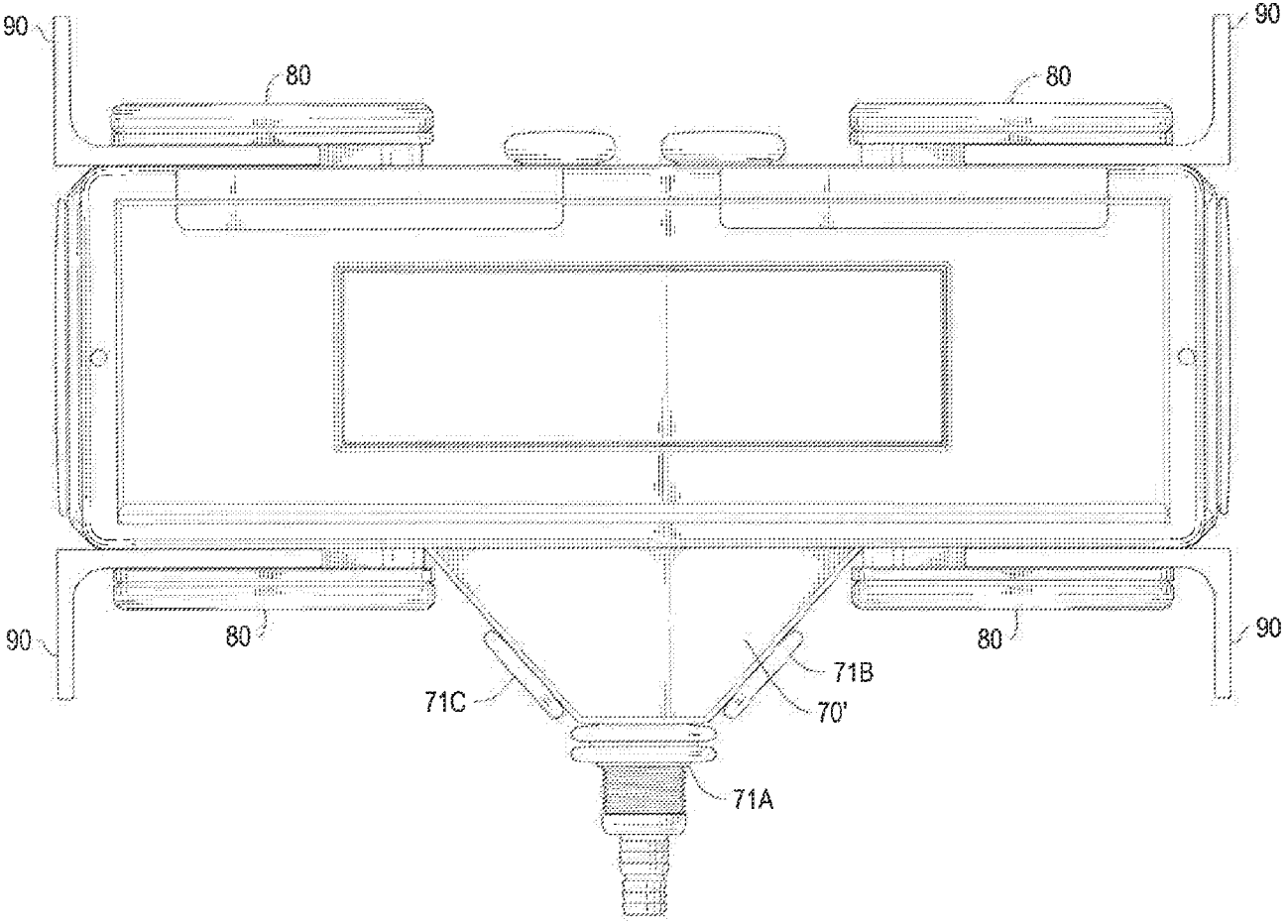
FIG. 27 is a front elevational view of the rough-in box according to a third embodiment.

FIG. 27 is a front elevational view of the rough-in box according to a third embodiment. The third embodiment differs from the first and second embodiments in that two additional large lineset ports 80 are provided on the bottom surface of the rough-in box and a smaller central sump 70' having three locations 71A, 71B and 71C for the drain outlet is provided. The third embodiment can be used instead of the first and second embodiments. That is, the central sump 70' can be used to provide a downward extending drain outlet if location 71A is used (like, the FIG. 13 embodiment). In addition, the central sump 70' can be used to provide a leftward extending drain outlet if location 71C is used or a rightward extending drain outlet if location 71B is used (like the FIG. 2 embodiment). Each of the locations 71A, 71B and 71C can be provided with a removable cap (like the caps for ports 50, for example) and the cap is then removed at the location that will be used as the drain outlet. FIG. 27 shows the location 71A being used as the drain outlet. Preferably one of the couplings 400, 420 of FIGS. 25A and 25B is used with the third embodiment so that the locations 71A, 71B and 71C do not need to be formed with coupling structures (such as the elements 72,74,76 described earlier).

The above-described exemplary embodiments are merely illustrative. Various alterations may be made.

What is claimed is:

1. An evaporator rough-in box comprising:

a plurality of walls that define and enclose a chamber;

a first one of the walls having cutting lines that encircle a faceplate, a first one of the cutting lines defining an integral hinge that maintains the faceplate attached to the first one of the walls when a remainder of the cutting lines, other than the first one of the cutting lines, are cut so that the faceplate can move between an open position and a closed position;

a closure that maintains the faceplate in the closed position by attaching an edge of the faceplate to the first one of the walls;

ports provided in at least one of the walls; and a drainage sump formed by a vertically lowermost wall of the plurality of walls of the rough-in box, the drainage sump having a drain outlet.

2. The evaporator rough-in box according to claim 1, wherein the ports include covers.

3. The evaporator rough-in box according to claim 1, wherein the closure includes at least one clip that is removably attached to the faceplate.

4. The evaporator rough-in box according to claim 1, further comprising:

mounting brackets that are adjustably attached to the rough-in box.

5. The evaporator rough-in box according to claim 4, wherein at least one of the mounting brackets is adjustably attached to a surface that forms at least part of one of the ports.

6. The evaporator rough-in box according to claim 1, wherein at least one of the ports has a rounded edge.

7. The evaporator rough-in box according to claim 1, further comprising a mounting plate provided within the rough-in box above the sump, the mounting plate is configured to mount one or more components of a condensate pump system.

8. The evaporator rough-in box according to claim 7, wherein the mounting plate is removably mounted within the rough-in box.

9. The evaporator rough-in box according to claim 8, wherein the mounting plate is the faceplate after the faceplate has been entirely removed from the first one of the walls by cutting the first one of the cutting lines that defines the integral hinge upon connection of an air conditioning unit to the evaporator rough-in box.

10. The evaporator rough-in box according to claim 9, wherein the faceplate includes reinforcing ridges.

11. The evaporator rough-in box according to claim 1, wherein the drain outlet includes at least two different couplings in series with each other.

12. The evaporator rough-in box according to claim 11, wherein the at least two different couplings differ in size.

13. The evaporator rough-in box according to claim 11, wherein the at least two different couplings differ in type.

14. The evaporator rough-in box according to claim 11, wherein the at least two different couplings differ in size and type.

15. The evaporator rough-in box according to claim 11, wherein the at least two different couplings are non-concentric.

16. The evaporator rough-in box according to claim 1, wherein the drain outlet includes at least three different couplings in series with each other.

17. The evaporator rough-in box according to claim 16, wherein the three different couplings differ in size from each other.

18. The evaporator rough-in box according to claim 1, wherein the drain outlet is non-concentric with an outlet of the sump.

19. The evaporator rough-in box according to claim 1, wherein at least the first one of the walls includes a protruding frame that protrudes from a remainder of the first one of the walls.

20. The evaporator rough-in box according to claim 19, wherein the faceplate is encircled by the protruding frame.

21. The evaporator rough-in box according to claim 1, wherein the drain outlet is located at a center of the lowermost wall of the rough-in box and extends downward.

22. The evaporator rough-in box according to claim 1, wherein the drain outlet extends laterally.

23. The evaporator rough-in box according to claim 2, wherein the covers of at least some of the ports include score lines that partition the cover into portions to enable only a part of the cover to be removed.

24. The evaporator rough-in box according to claim 2, wherein the covers of at least some of the ports include score lines that enable the cover to be cut without removing the cover from the port.

25. The evaporator rough-in box according to claim 1, further comprising a coupling installed in the drain outlet and by which a condensate line of an air-conditioning unit that is used with the rough-in box is connected to a drain line that is attached to the drain outlet.

26. The evaporator rough-in box according to claim 1, wherein the drain sump has at least two outlet locations to which the drain outlet can be connected, the drain outlet being connected to a first one of the two outlet locations, a remainder of the outlet locations, other than the first one of the outlet locations, being covered.

* * * * *